US012359544B1

(12) United States Patent
Smith

(10) Patent No.: US 12,359,544 B1
(45) Date of Patent: Jul. 15, 2025

(54) GAS LIFT DEVICE HAVING NOZZLE WITH SPIRALING VANE

(71) Applicant: Weatherford Technology Holdings, LLC, Houston, TX (US)

(72) Inventor: Matthew Smith, Cankton, LA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/660,662

(22) Filed: May 10, 2024

Related U.S. Application Data

(60) Provisional application No. 63/645,307, filed on May 10, 2024.

(51) Int. Cl.
*E21B 43/12* (2006.01)

(52) U.S. Cl.
CPC ..... *E21B 43/123* (2013.01)

(58) Field of Classification Search
CPC ..... E21B 43/121; E21B 43/122; E21B 43/123
See application file for complete search history.

(56) References Cited

U.S. PATENT DOCUMENTS

| | | | |
|---|---|---|---|
| 3,023,810 | A | 3/1962 | Anderson |
| 4,371,382 | A | 2/1983 | Ross |
| 5,212,891 | A | 5/1993 | Schuermann et al. |
| 5,743,717 | A | 4/1998 | Schmidt |
| 6,568,473 | B2 | 5/2003 | Almeida |
| 6,568,478 | B2 | 5/2003 | Almeida |
| 6,708,763 | B2 | 3/2004 | Howard et al. |
| 8,006,757 | B2 | 8/2011 | Hackworth et al. |
| 9,581,258 | B2 | 2/2017 | Fletcher et al. |
| 9,732,871 | B2 | 8/2017 | Fletcher et al. |
| 9,879,509 | B2 | 1/2018 | Almeida |
| 10,408,026 | B2 | 9/2019 | Haley et al. |
| 10,480,275 | B2 | 11/2019 | Velde et al. |
| 11,008,848 | B1 | 5/2021 | Webber et al. |
| 2001/0025651 | A1 | 10/2001 | Almeida |
| 2004/0182437 | A1 | 9/2004 | Messick |
| 2006/0027372 | A1 | 2/2006 | Shaposhnikov et al. |
| 2006/0076145 | A1 | 4/2006 | Lembcke et al. |
| 2007/0193752 | A1 | 8/2007 | Kim |
| 2007/0215358 | A1 | 9/2007 | Messick et al. |
| 2011/0127043 | A1 | 6/2011 | Hahn et al. |
| 2014/0356194 | A1 | 12/2014 | Ahmed et al. |
| 2016/0195189 | A1 | 7/2016 | Fletcher et al. |
| 2016/0327169 | A1 | 11/2016 | Yazykov |
| 2024/0133276 | A1* | 4/2024 | Brown ..... E21B 23/12 |

* cited by examiner

*Primary Examiner* — Kristyn A Hall
(74) *Attorney, Agent, or Firm* — Cabello Hall Zinda, PLLC

(57) ABSTRACT

A gas lift device includes a housing, a valve, and a nozzle. The housing defines a chamber and defines an inlet and an outlet in communication with the chamber. The valve in the chamber permits fluid communication from the inlet toward the outlet and prevents fluid communication in the reverse. The nozzle disposed in the chamber has a converging section, a throat, and a diverging section, which extend along a longitudinal axis of the chamber. A surface of the converging section converges inwardly from the chamber to the throat to funnel fluid communication from the inlet to the throat. A flow restriction of the throat restricts the fluid communication from the converging section to the diverging section. A surface of the diverging section diverges outwardly from the throat toward the outlet. Vanes extend inwardly in the diverging section and spiral about the longitudinal axis.

20 Claims, 13 Drawing Sheets

GAS LIFT DEVICE HAVING NOZZLE WITH SPIRALING VANE

CROSS-REFERENCE TO RELATED APPLICATIONS

This application claims the benefit of U.S. Provisional Appl. No. 63/645,307 filed May 10, 2024, which is incorporated herein by reference in its entirety.

BACKGROUND OF THE DISCLOSURE

To obtain hydrocarbon fluids from an earth formation, a wellbore is drilled into an area of interest within a formation. The wellbore may then be "completed" by inserting casing in the wellbore and setting the casing using cement. Alternatively, the wellbore may remain uncased as an "open hole"), or it may be only partially cased. Regardless of the form of the wellbore, production tubing is run into the wellbore to convey production fluid (e.g., hydrocarbon fluid, which may also include water) to the surface.

Often, pressure within the wellbore is insufficient to cause the production fluid to naturally rise through the production tubing to the surface. In these cases, an artificial lift system can be used to carry the production fluid to the surface. One type of artificial lift system is a gas lift system, of which there are two primary types of systems: tubing-retrievable gas lift systems and wireline-retrievable gas lift systems. Each type of gas lift system uses several gas lift valves spaced along the production tubing. The gas lift valves allow gas to flow from the annulus into the production tubing so the gas can lift production fluid in the production tubing. Yet, the gas lift valves prevent fluid from flowing in the opposite direction from the production tubing into the annulus.

FIG. 1 shows a typical wireline-retrievable gas lift system 10. Operators inject compressed gas G into the borehole annulus 22 between a production tubing string 20 and the casing 24 within a cased wellbore 26. A valve system 12 supplies the injection gas G from the surface and allows produced fluid to exit the gas lift system 10.

Side pocket mandrels 30 spaced along the tubing string 20 hold gas lift valves 40 within side pockets 32. As noted previously, the gas lift valves 40 are one-way valves that allow gas flow from the borehole annulus 22 into the tubing string 20 and prevent reverse flow from the tubing string 20 into the borehole annulus 22.

A production packer 14 located on the tubing string 20 forces the flow of production fluid P from a formation up through the tubing string 20 instead of up through the borehole annulus 22. Additionally, the production packer 14 forces the gas flow from the borehole annulus 22 into the tubing string 20 through the gas lift valves 40.

In operation, the production fluid P flows from the formation into the wellbore 26 through casing perforations 28 and then flows into the production tubing string 20. When it is desired to lift the production fluid P, compressed gas G is introduced into the borehole annulus 22, and the gas G enters from the borehole annulus 22 through ports 34 in the mandrel's side pockets 32. Disposed inside the side pockets 32, the gas lift valves 40 control the flow of injected gas I into the tubing string 20. As the injected gas I rises to the surface, it helps to lift the production fluid P up the tubing string 20 to the surface.

Gas lift valves 40 have been used for many years to assist production of fluid to the surface. The valve 40 uses pressure-sensitive valve mechanism having a metal bellows and a piston to convert pressure into movement. Injected gas acts on the bellows to open the pressure-sensitive valve mechanism, and the gas passes through the valve 40 into the tubing string. As differential pressure is reduced on the bellows, the valve mechanism in the valve 40 can close.

Depending on the completion, other types of downhole devices may be installed in the side pocket mandrels 30. For example, "dummy" valves can be installed in the side pockets 32 of the mandrels 30 to allow for certain pressure tests to be performed. These dummy valves are not actually valves because they merely position in the mandrels 30 to seal of the mandrel's ports 34, acting as isolation devices.

Yet another type of downhole device includes a gas lift device, which may be installed in a side pocket mandrel or other type of mandrel. Examples include devices disclosed in U.S. Pat. Nos. 5,743,717, 6,568,473, 6,568,478, US 2001/0025651, US 2007/0215358, and US 2011/0127043. These gas lift device include a restriction with a nozzle structure to increase the velocity of the gas passing through the device.

The subject matter of the present disclosure is directed to overcoming, or at least reducing the effects of, one or more of the problems set forth above.

SUMMARY OF THE DISCLOSURE

A gas lift device disclosed herein is for use on tubing in a wellbore. The gas lift device comprises a housing and a nozzle structure. The housing defines a chamber and defines an inlet and an outlet in communication with the chamber. The nozzle structure is disposed in the chamber and defines a flow passage therethrough along a longitudinal axis. The nozzle structure has one or more vanes extending inwardly in the flow passage toward the longitudinal axis, and the one or more vanes spiral about the longitudinal axis. The nozzle structure has a converging section, a throat, and a diverging section extending along the longitudinal axis. The converging section has a converging surface, which converges inwardly to the throat and is configured to funnel fluid communication to the throat. The throat defines a flow restriction, which is configured to restrict fluid communication from the converging section to the diverging section. The diverging section has a diverging surface, which diverges outwardly from the throat and is configured to direct fluid communication out of the nozzle structure toward the outlet.

The chamber of the housing can define the nozzle structure integrally formed therein. Alternatively, the nozzle structure can comprise an insert inserted in the chamber between the inlet and the outlet. The insert can have the one or more vanes, the converging section, the throat, and the diverging section. For its part, the chamber can define a shoulder so the insert can be disposed against the shoulder. The gas lift device can comprise a fixture engaged between the insert and the chamber and holding the insert against the shoulder. A seal can be engaged between the insert and the chamber and sealing an annular area therebetween.

In configurations, the gas lift device can further comprise a valve element disposed in the chamber. The valve element can be configured to permit fluid communication from the inlet toward the outlet and can be configured to prevent fluid communication from the outlet toward the inlet.

In one example, the valve element can comprise a poppet moveably disposed in the outlet between an opened condition and a closed condition. The poppet can be biased by a spring toward the closed condition, and the poppet can be moveable from the closed condition to the opened condition in response to a pressure differential overcoming a bias of the spring. In other examples, the valve element can be disposed in the chamber between the inlet and the nozzle structure, or the valve element can be disposed in the chamber between the nozzle structure and the outlet.

In configurations, the nozzle structure can comprise an inlet section and an outlet section. The inlet section can define a pocket communicating the chamber with the outlet section, and the pocket can have the one or more vanes extending inwardly toward the longitudinal axis. The outlet section can have the converging section, the throat, and the diverging section.

In other configurations, the one or more vanes can extend inwardly from the diverging surface toward the longitudinal axis. In this case, the one or more vanes can have inner edges exposed in the diverging section, and the inner edges can define an open central area within the flow passage through the diverging section. The open central area can restrict inward from the throat to an intermediate location of the open central area and can diverge outwardly from the intermediate location to an end of the diverging section.

Overall, the configurations can have one or more of a number of the one or more vanes, a thickness of the one or more vanes, an inward extent of the one or more vanes, and a circumferential turn of the one or more vanes spiraling about the longitudinal axis, which are configured to produce laminar flow of the fluid communication through the nozzle structure from the inlet to the outlet. Also, the one or more vanes can define at least two circumferential turns spiraling about the longitudinal axis.

In yet other configurations, a pressure-sensitive valve can be disposed in the chamber and can be movable relative to the nozzle structure. The pressure-sensitive valve can comprise a piston and a bellows. The piston can be movably disposed in the chamber along the longitudinal axis. The bellows can be connected between the chamber and the piston. The bellows can separate a first portion of the chamber having the inlet from a second portion of the chamber holding a pressure charge.

In further configurations, the housing can be configured to position in a side pocket of a bore in a mandrel. The housing can have first and second annular seals disposed externally thereabout. The inlet can be defined in the housing between the first and second annular seals, and the outlet can be in communication with the bore of the mandrel. As an alternative, the housing can be configured to affix to an opening externally on a mandrel. The inlet can be in communication with an annulus, and the outlet can be in communication with a bore of the mandrel.

A gas lift system is disclosed herein for use on tubing in a wellbore. The gas lift system comprises a mandrel and a gas lift device. The mandrel is configured to position on the tubing in the wellbore, and the mandrel has a bore. The gas lift device has any of the configuration noted above and is configured to position on the mandrel.

The mandrel can define a side pocket adjacent the bore and can be configured to receive the gas lift device therein. Alternatively, the mandrel can define an external port communicating with the bore. The external port can be configured to connect to the gas lift device disposed adjacent the mandrel.

A kit disclosed herein is configured to retrofit a gas lift device used on tubing in a wellbore. The kit comprises a housing portion and a nozzle structure. The housing portion is configured to connect to the gas lift device, and the housing portion defines a chamber communicating therethrough. The nozzle structure can have any of the features described above.

The housing portion can define the inlet for the gas lift device. The kit can further comprise a valve being configured to insert in a portion of the housing portion. The valve can be configured to permit fluid communication from an inlet of the gas lift device toward an outlet of the gas lift device and can be configured to prevent fluid communication from the outlet toward the inlet.

A method is disclosed herein of producing downhole fluid to surface using tubing in a wellbore. The method comprises: permitting gas to flow through an inlet into a chamber of a gas lift device; funneling the gas from the inlet through a converging section of a nozzle structure in the chamber; restricting the gas from the converging section through a throat of the nozzle structure to a diverging section of the nozzle structure; diverging the gas with a diverging surface of the diverging section diverging outwardly from the throat toward an outlet of the gas lift device; imparting rotation to the gas toward the outlet using one or more vanes, which extend inwardly toward a longitudinal axis of the nozzle structure and spiraling about the longitudinal axis; and outputting the gas from the outlet of the gas lift device to communicate with the downhole fluid.

The foregoing summary is not intended to summarize each potential embodiment or every aspect of the present disclosure.

DETAILED DESCRIPTION OF THE DISCLOSURE

Figure 1:
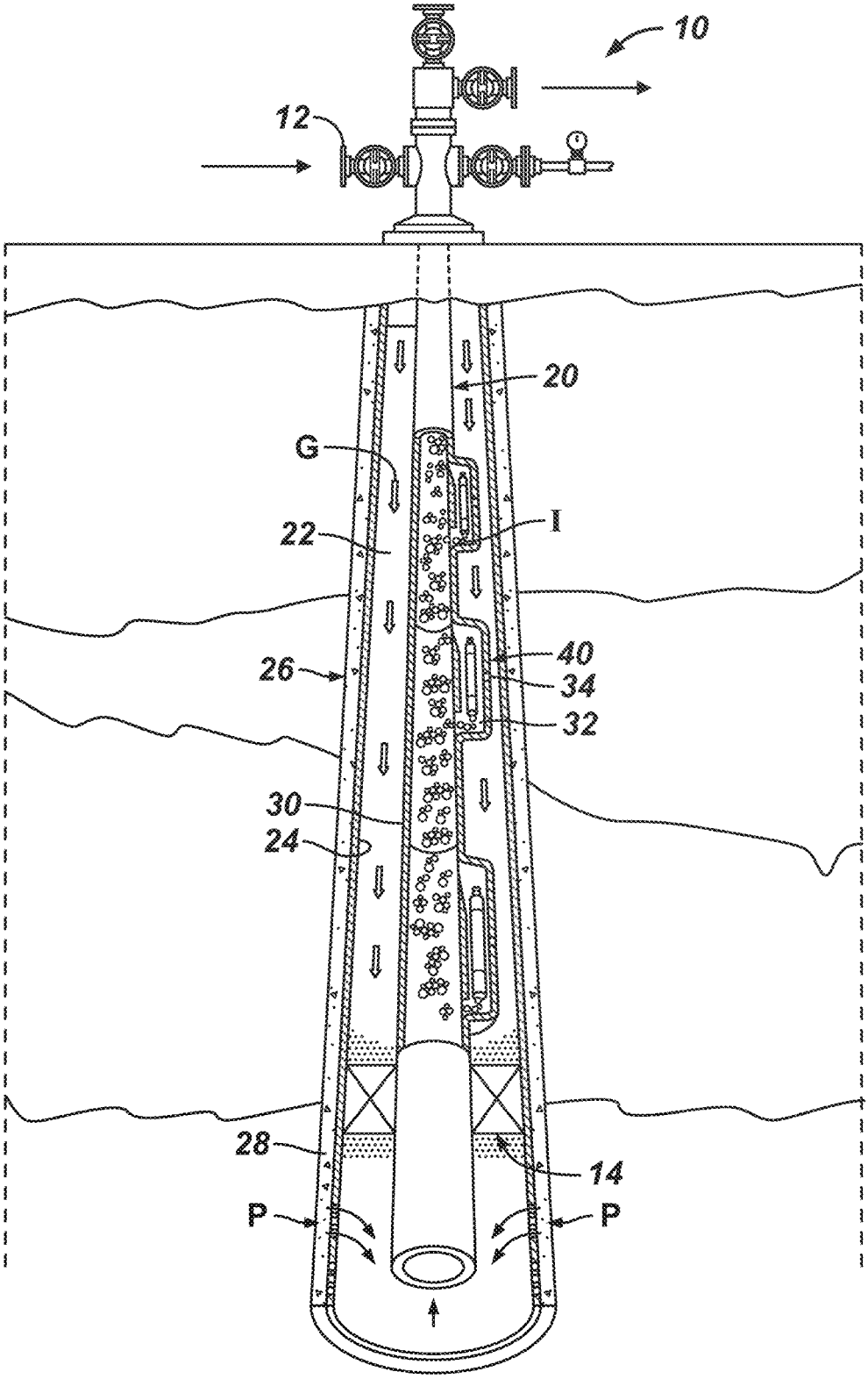
FIG. 1 (Prior Art)
FIG. 1 illustrates a conventional gas lift system.
Figure 2A:
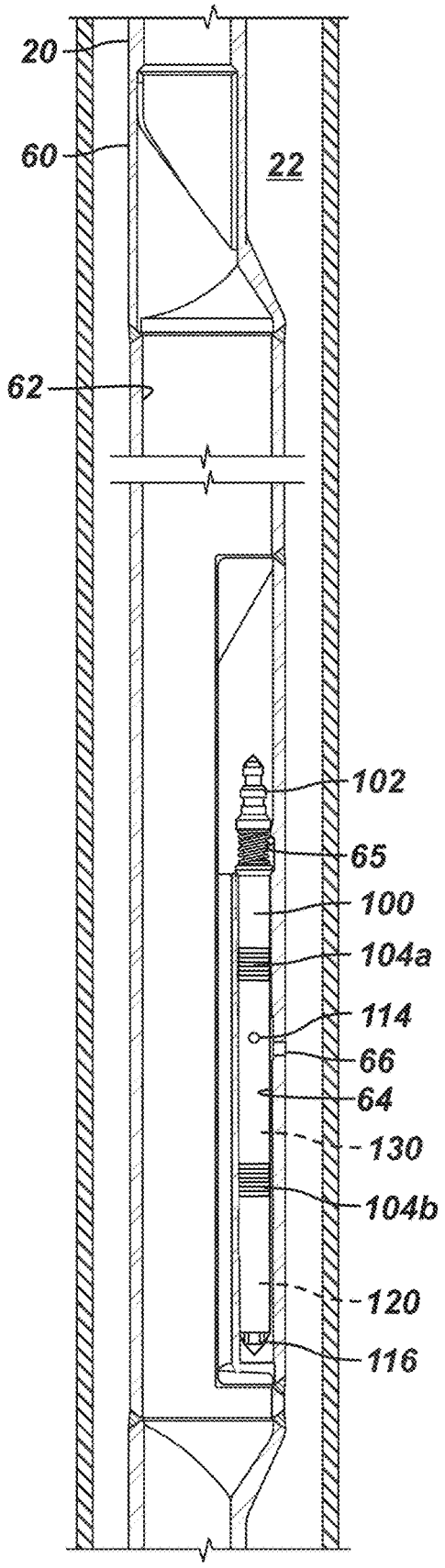
FIGS. 2A-2B illustrate a gas lift device of the present disclosure installed on mandrels downhole.
Figure 2B:
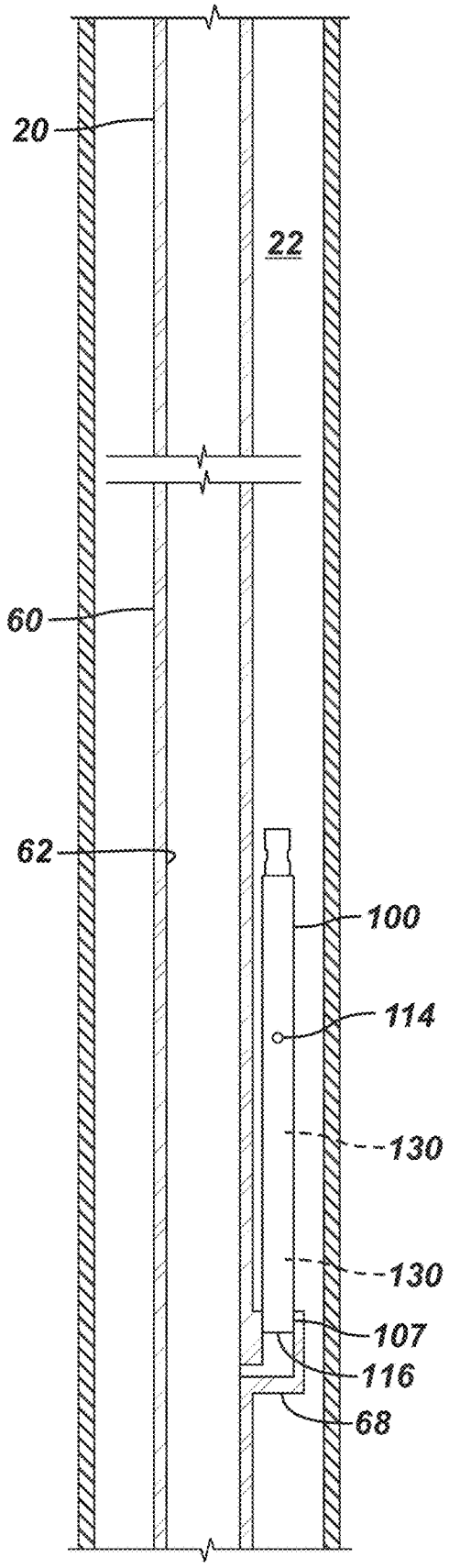

Referring to FIGS. 2A-2B, a gas lift device 100 of the present disclosure is installed on a mandrel 60 of a tubing string 20 for a wellbore completion. As shown in FIG. 2A, the gas lift device 100 is wireline-retrievable, being installed in a side pocket 64 of a side pocket mandrel 60 disposed on the tubing string 20. This gas lift device 100 can be deployed and retrieved using wireline. For example, the gas lift device 100 can be run into the tubing sting 20 by wireline and can be inserted into the side pocket 64 formed to the side of the mandrel's bore 62. A latch 102 of the device 100 engages a profile 65 in the side pocket 64 to hold the device 100 therein. Packing seals 104*a-b* on the device 100 isolate fluid communication between an injection gas port 66 on the mandrel 60 and an inlet 114 on the device 100. Meanwhile, an outlet 116 on the gas lift device 100 can communicate with the mandrel's bore 62.

By contrast, the gas lift device 100 as shown in FIG. 2B is tubing-retrievable, being installed externally on a mandrel 60 of the tubing string 20. In this arrangement, the device 100 is deployed with the tubing string 20 and can be retrieved by retrieving the tubing string 20. An end 107 of the device 100 can affix to an external fixture 68 on the mandrel 60. For example, the end 107 of the housing 110 can thread into the external fixture 68 so the device's outlet 116 can be placed in communication with the mandrel's bore 62 of the mandrel 60. The inlet 114 is placed in communication with the borehole annulus 22.

In both cases, the gas lift device 100 includes a flow control structure 130 according to the present disclosure. The gas lift device 100 may further include a valve 120 to prevent reverse flow through the device 100. For its part, the flow control structure 130 can control the flow of fluid (e.g., gas injected in the borehole annulus 22) through the device 100 in a manner discussed below.

For example, the gas lift device 100 can be used for a typical tubing flow application. In this instance as will be described throughout the present disclosure, gas is injected down the borehole annulus 22 in order to enter the tubing string 20 through the mandrel 60 and the gas lift device 100 so the injected gas can then lift production fluid up the tubing string 20. In this case, the flow control structure 130 controls the flow of the gas passing through the device 100 from the inlet 114 to the outlet 116 so the gas flows from the borehole annulus 22 to the tubing string 20. The valve 120 operates with the pressure differential between the inlet 114 and outlet 116 to configure the active opening of the gas lift device 100. Accordingly, the valve 120 allows for the flow of the gas from the inlet 114 to the outlet 116 so the gas flows from the borehole annulus 22 to the tubing string 20, but prevents flow of fluid and gas in the opposite direction.

As an alternative, the gas lift device 100 can be used in annular flow configuration in which gas is instead injected down the tubing string 20 in order to enter the borehole annulus 22 through the gas lift device 100 and the mandrel 60 so the injected gas can then lift production fluid up the borehole annulus 22. Although the annular flow configuration is less common, it is applied in certain circumstances. To achieve the annular flow configuration, features, and operation of the disclosed gas lift device 100 and its internal features 120, 130 are essentially reversed, and a different form of gas lift mandrel 60 may be used. In general, the inlet of the gas lift device 100 for this case would be exposed to the tubing string 20 instead of the borehole annulus 22, while the outlet of the gas lift device 100 would be exposed to the borehole annulus 22 instead of the tubing string 20. The valve 120 operates with the pressure differential between the inlet and outlet to configure the active opening of the gas lift device 100.

Figure 3A:
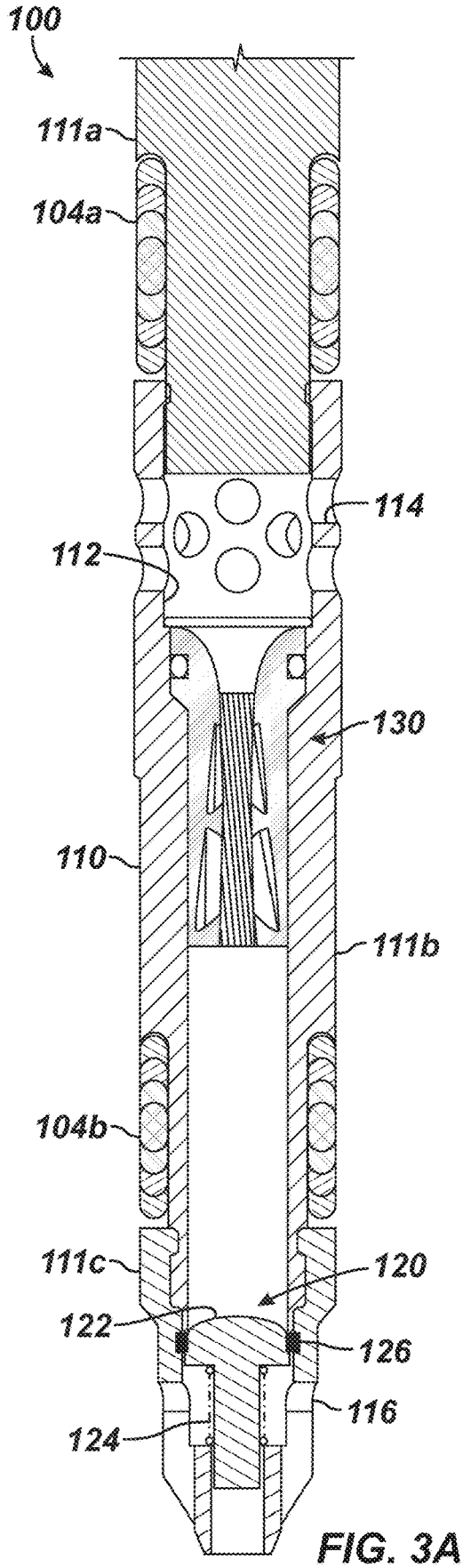
FIGS. 3A-3B illustrate detailed cross-sections of portions of a gas lift device having a flow control structure of the present disclosure.
Figure 3B:
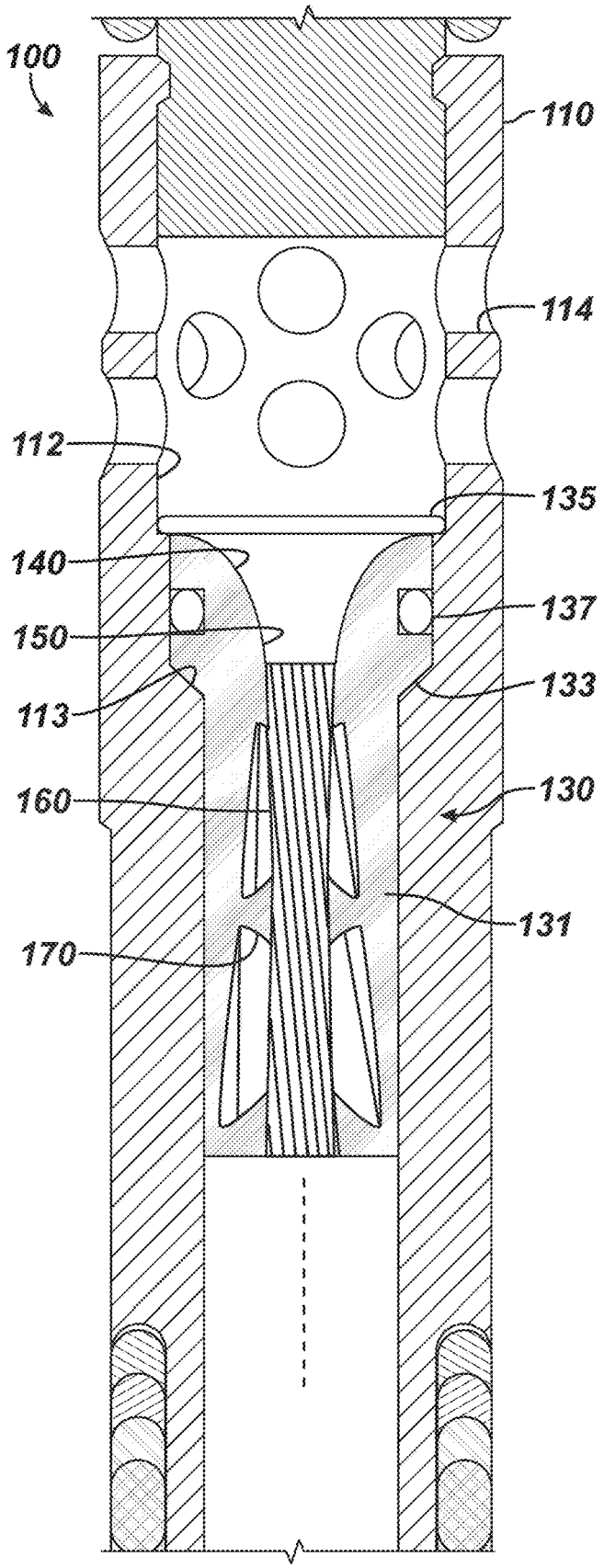

FIGS. 3A-3B illustrate detailed cross-sections of portions of a gas lift device 100 of the present disclosure. As shown in FIG. 3A, the current gas lift device 100 is a type that installs inside a side pocket mandrel and can be retrieved using wireline or the like. Additionally, the current gas lift device 100 is configured for a typical tubing flow application. As will be appreciated, a tubing-retrievable configuration of the gas lift device 100 would have similar internal features, and an annular flow configuration can be used with appropriate modification.

As shown in FIG. 3A, the gas lift device 100 includes a housing 110, a valve 120, and a flow control or nozzle structure 130. The housing 110 defines a chamber 112 and defines an inlet 114 and an outlet 116 in communication with the chamber 112. The housing 110 has upper and lower seals 104*a-b* disposed thereabout. The seals 104*a-b* separate the inlet 114, which can include one or more inlet ports placed in communication with an injection gas port (66) of a side pocket mandrel (60).

The valve 120 is disposed in the chamber 112. The valve 120 is configured to permit fluid communication from the inlet 114 toward the outlet 116 and is configured to prevent fluid communication from the outlet 116 toward the inlet 114. In general, the outlet 116 can include one or more outlet ports. The valve 120 keeps the flow from the production string (not shown) from going through the device's outlet 116 and back into the (annulus) from the device's inlet 114. Yet, the valve 120 allows injected gas to pass from the inlet 114 and out the outlet 116.

As shown in FIG. 3A, the valve 120 can be a check valve, such as a poppet valve, although other valve arrangements can be used. As a poppet valve, the valve 120 includes a poppet 122 moveably disposed in the outlet 116 between an opened condition and a closed condition relative to a seat 126 disposed in the chamber 112. The poppet 122 is biased by a spring 124 to the closed condition. During use, the poppet 122 is moveable from the closed condition to the opened condition away from the seat 126 in response to a pressure differential overcoming the bias of the spring 124.

The device's chamber 112 has the flow control or nozzle structure 130, which can have the form of a convergent-divergent nozzle, a de Laval nozzle, a venturi, or the like. The nozzle structure 130 has a converging section or nozzle inlet 140, a throat 150, and a diverging section or nozzle exit 160 extending along a longitudinal axis A. The converging section 140 has converging surface 141 that converges inward from the chamber 112 to the throat 150 and that is configured to funnel the fluid communication in the chamber 112 from the inlet 114 to the throat 150 of the nozzle structure 130. In turn, the throat 150 has a flow restriction 151 configured to restrict the fluid communication from the converging section 140 to the diverging section 160 of the nozzle structure 130. For its part, the diverging section 160 has a diverging surface 161 that diverges outwardly from the throat 150 toward the outlet 116. The diverging surface 161 of the diverging section 160 has one or more vanes 170 extending inwardly toward the longitudinal axis and spiraling about the longitudinal axis A. As shown, a plurality of vanes 170 are provided and spiral about the longitudinal axis A.

In general, the surfaces 141, 161 and the restriction 151 through nozzle structure 130 follow an asymmetric hourglass shape. The flow of gas through the nozzle structure 130 can go through a venturi effect. The pressure of the gas decreases and its velocity increases as the gas flows through the throat 150 to the diverging section 160. The spiraling vanes 170 produce swirl in the gas flow. As a result, turbulence in the gas flow is decreased through the nozzle structure 130, and the gas flow becomes more laminar. The gas flow, which is compressible, can be further accelerated through the nozzle structure 130 by the conversion of the thermal energy of the flow into kinetic energy.

In one configuration, the nozzle structure 130 with the surfaces 141, 161, the restriction 151, and the vanes 170 can be integrally formed, machined, cast, or the like in the sidewall of the chamber 112. For assembly and manufacturing purposes, the nozzle structure 130 in another configuration as shown in FIGS. 3A-3B can be comprised of a flow control insert 131 that is inserted in the chamber 112 between the inlet 114 and the outlet 116. The flow control insert 131 has an inner passage therethrough in which the converging section 140, the throat 150, and the diverging section 160 are formed. In this configuration, the chamber 112 can define a shoulder 113, and the flow control insert 131 can be disposed against the shoulder 113. A fixture 135, such as a snap ring, can be engaged between the flow control insert 131 and the chamber 112 to hold the flow control insert 131 against the shoulder 113. A seal 137 can be engaged between the flow control insert 131 and the chamber 112 to seal an annular area therebetween.

Further details of the flow control insert 131 of the present disclosure are shown in FIGS. 4A-4D, which include side, perspective, top, and bottom views of the flow control insert 131 for a nozzle structure 130 of a gas lift device 100. Additionally, FIGS. 5A-5D illustrate additional side, top, cross-sectional, and bottom views of the flow control or nozzle structure 130. (Not all features may be labelled.)

Figure 6:
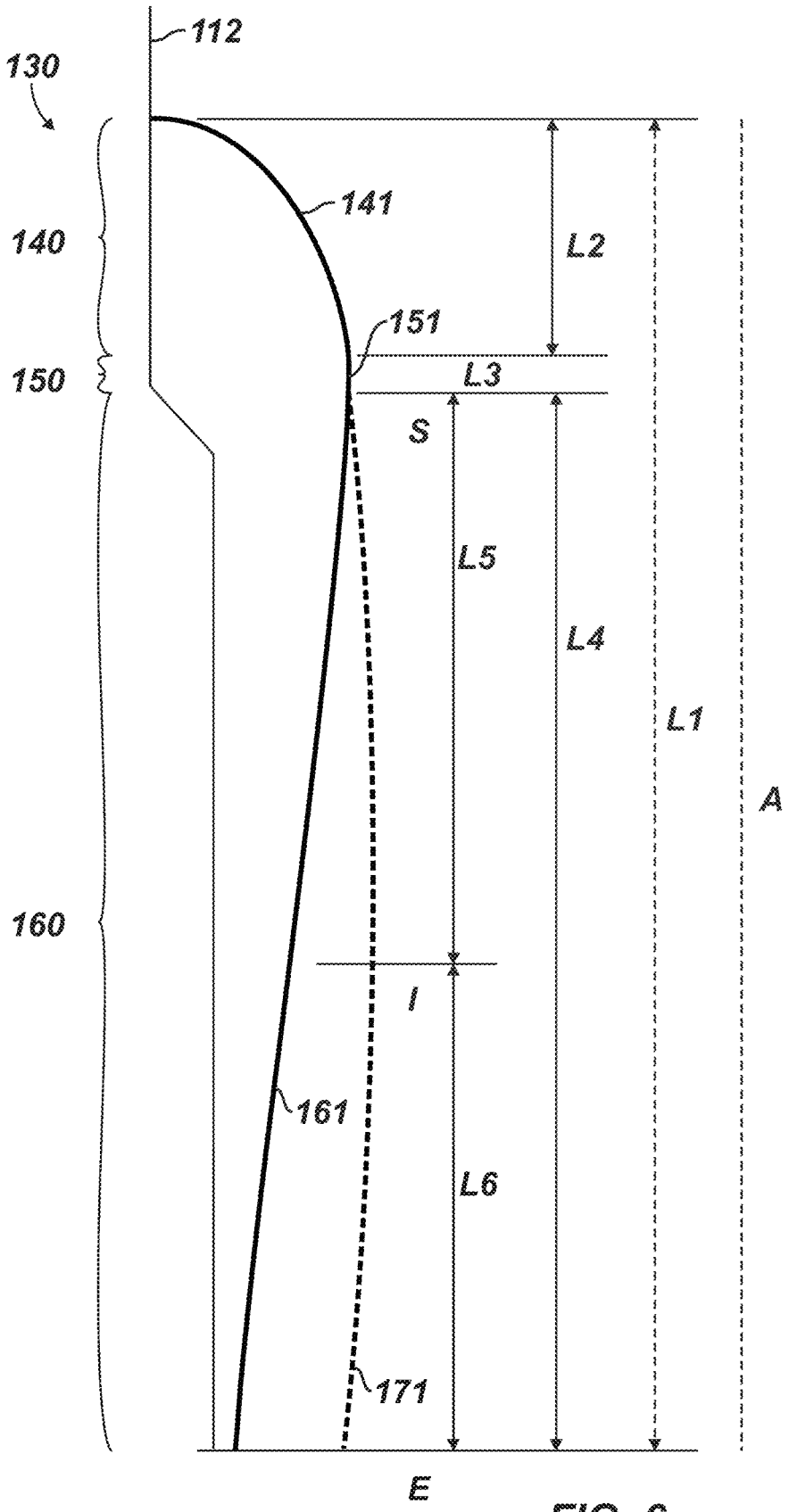
FIG. 6 schematically illustrates contours for features of the flow control structure of the present disclosure.

Looking at the nozzle structure 130 in more detail, FIG. 6 schematically illustrates contours for the features of the nozzle structure 130 of the present disclosure. The nozzle structure 130 has an axial extent L1 along the axis A. The converging surface 141 of the converging section 140 converges symmetrically inward from the chamber 112 toward the axis A and extends an axial extent L2 along the axis A. The flow restriction 151 of the throat 150 is arranged transverse to and symmetrical about the longitudinal axis A. The flow restriction 151 may or may not have some axial extent L3 along the axis A. The diverting surface 161 of the diverging section 160 extends downwardly from the throat 150 and diverges symmetrically outwardly from the axis A. The diverting surface 161 extends a remaining extent L4 along the axis A of the structure's full extent L1.

The converging section 140 forms an upstream converging portion that forms a progressive constriction in a cross-sectional area from the chamber 112. The throat 150 forms an intermediate portion located downstream of converging section 140 and defines a substantially constant cross-sectional area for the passage of gas flow. The cross-sectional area of the throat 150 is smaller than the original cross-sectional area of the chamber 112. The diverging section 160 forms a downstream diverging portion, located downstream of the throat 150, and defines a progressive widening in the cross-section area for the passage of the gas flow.

Figure 4A:
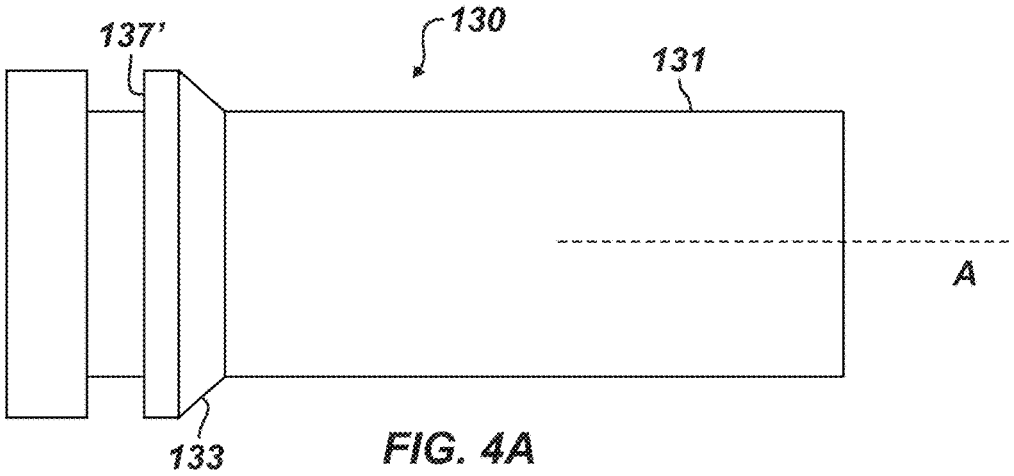
FIGS. 4A-4D illustrate side, perspective, top, and bottom views of a flow control structure for a gas lift device of the present disclosure.
Figure 4B:
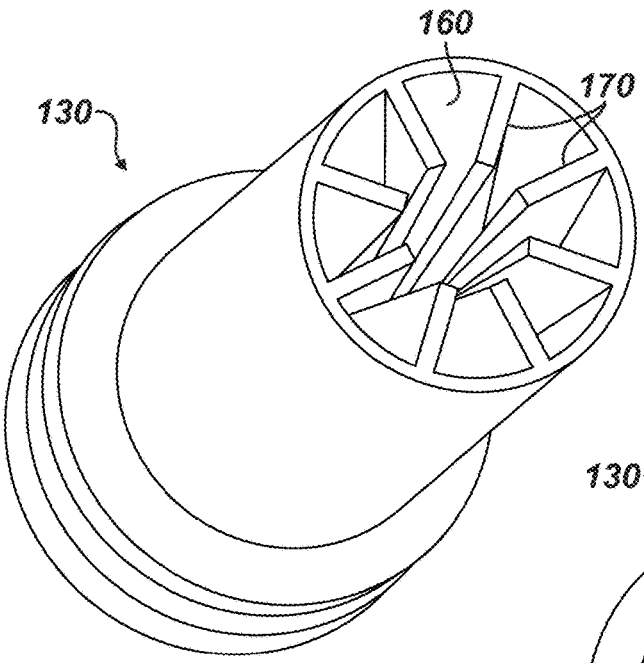
Figure 4C:
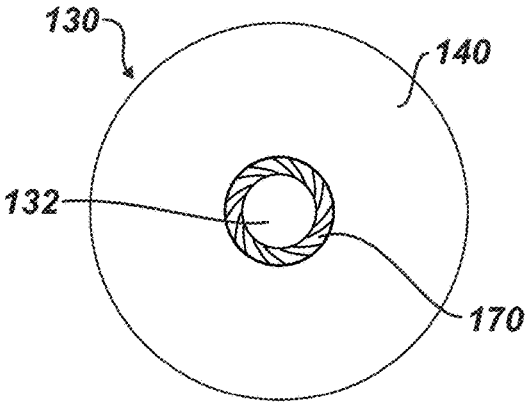
Figure 4D:
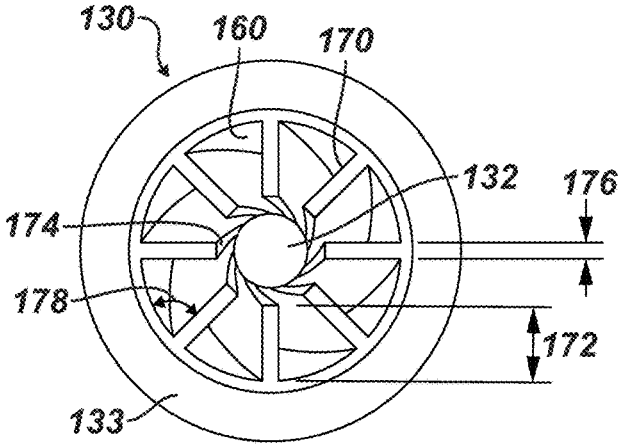
Figure 5B:
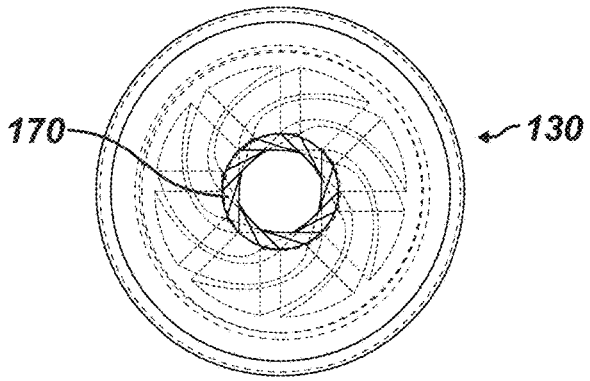
FIGS. 5A-5D illustrate additional side, top, cross-sectional, and bottom views of the flow control structure.
Figure 5A:
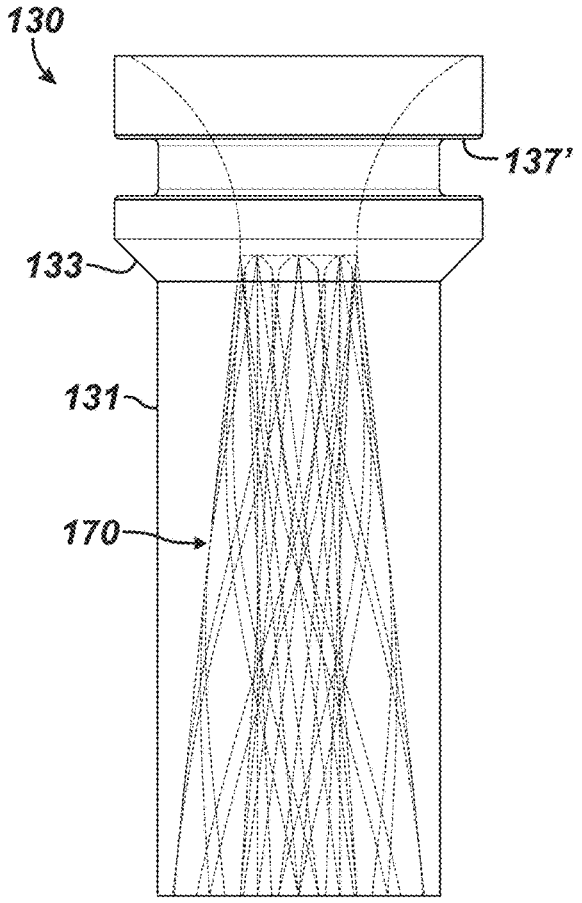
Figure 5C:
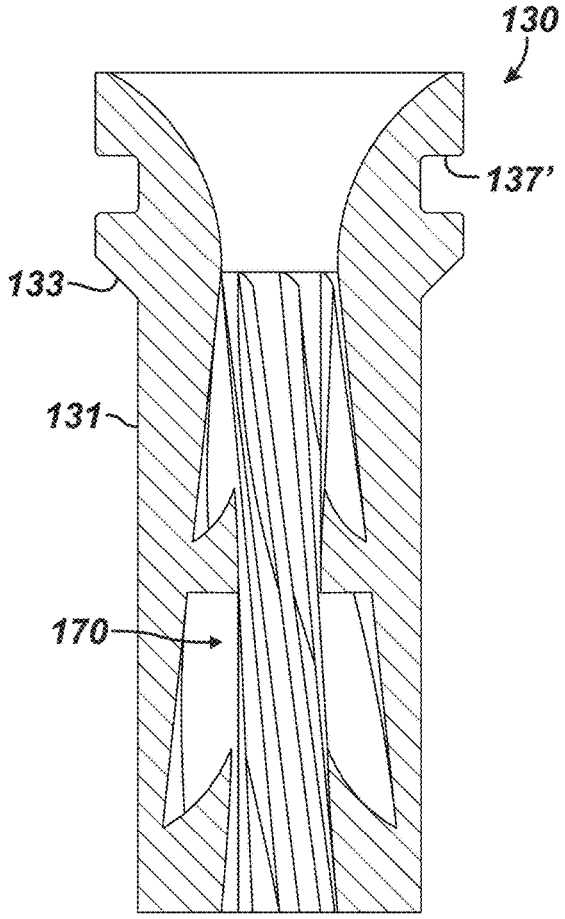
Figure 5D:
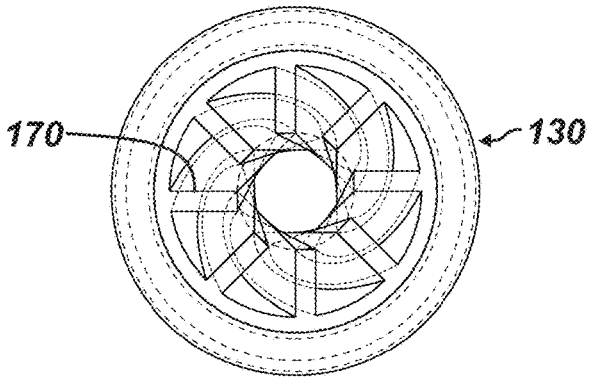

The vanes 170 extend along a longitudinal length of the sidewall of the diverging section 160. For example, the vanes 170 can extend along most of or all of the extent L4 of the diverging section 160. As best shown in FIG. 4D, each of the vanes 170 has an inward extent 172 and a thickness 176. The inward extent 172 of the vanes 170 extends radially inward into an inner passage defined by the diverging section 160, where each of the vanes 170 terminates with an inner edge 174. The inner edges 174 of the vanes 170 define an open central area (132) through the diverging section 160.

As noted above and as shown in FIG. 5, the converting surface 141 of the converging section 140 has a funneling inlet portion that curves smoothly to the throat 150. For its part, the throat 150 presents a main restriction to the gas flow. The diverting surface 161 of the diverging section 160 is formed as an outwardly tapering conical portion extending from the throat to the end of the nozzle structure 130.

As also shown in FIG. 5, the inner edges of the vanes 170 form a contour 171 that follows the diverging surface 161 and extends from a start point S at the throat 150 to an end point E near the end of the nozzle structure 130. The vane's contour 171 converges inward to the longitudinal axis A along an extent L5 from the start point S at the throat 150 to an intermediate point I. From the intermediate point I, the vane's contour 171 diverges outward to the longitudinal axis A along an extent L6 from the intermediate point I to an end point E of the nozzle structure 130. Consequently, the open central area (132) through the nozzle structure 130 restricts inward from the throat 150 to an intermediate location of the open central area (132) and diverges outwardly from the intermediate location to an end of the nozzle structure 130.

As will be appreciated, the contours and geometries of the surfaces 141, 151, 161, 171 can be configured to provide desired results depending on the expected fluid(s), pressure(s), and flow rate(s) for a given implementation. Additionally, variations in the diameter of the open central area 132, relationships or ratios between the axial extents (L1, L2, L3), and the number of turns of the vanes 170 can be configured and selected to impact the flow and to induce rotating flow suitable for the given implementation.

Referring to FIGS. 3A-3B, 4A-4D, 5A-5D, and 6, the number of the vanes 170, the thickness 176 of the vanes 170, the inward extent 172 of the vanes 170 from the diverting surface (161) to the inner edges 174 of the vanes 170 at the longitudinal axis A, and a circumferential turn or pitch 178 of the vanes 170 about the longitudinal axis A is configured to produce laminar flow of the fluid communication from the inlet 114 to the outlet 116 of the gas lift device 100. The turn or pitch 178 represents the distance along the longitudinal axis A when the spiral of the vane 170 makes a complete turn about the longitudinal axis. As shown in the example of FIGS. 3A-3B, the vanes 170 can define at least two circumferential turns about the longitudinal axis A.

The nozzle structure 130 is a continuously open feature that allows the gas to flow through the device 100. As noted, the sidewall of the chamber 112 through the nozzle structure 130 can follow an asymmetric hourglass shape. Gas flow passing through the nozzle structure 130 experiences a drop in pressure and an increase in velocity across the throat 150. The gas flow passing through the nozzle structure 130 also experiences a drop in temperature across the throat 150. In this way, the gas flow, which is compressible, can be further accelerated through the nozzle structure 130 by the conversion of the thermal energy of the flow into kinetic energy.

The gas flow also experiences spinning by virtues of the spiraling vanes 170. The spinning gas introduces a further low-pressure force downstream, which draws more gas into the gas lift device 100. As a result, turbulence in the gas flow is decreased and the gas flow becomes more laminar. The injection of gas is therefore increased so that more gas can move through the gas lift device 100. The gas will also stay in a more laminar state as it flows through the gas lift device 100 because of the increased surface area of the vanes 170.

Turbulence is reduced in the gas flow, which will increase fluid flow efficiency of the gas lift device 100. The quantity, degree of rotation, and length of the vanes 170 can change based on the gas lift requirements.

In the example of FIGS. 3A-3B, the housing 110 is configured to position in a side pocket of a bore in a mandrel. Accordingly, the housing 110 has first and second annular seals 104*a-b* disposed externally thereabout. The inlet 114 defined in the housing 110 between the first and second annular seals 104*a-b*. When installed in the mandrel, the outlet 116 is placed in communication with the bore of the mandrel.

In other examples as noted herein, the housing 110 can be configured to affix to an opening externally on a mandrel. For example, the distal end of the housing 110 can thread into a fixture of the mandrel. The inlet 114 would be placed in communication with the wellbore annulus, and the outlet 116 would be placed in communication with a bore of the mandrel.

The housing 110 of the device 100 can be formed of several housing portions to facilitate manufacture and assembly. The inlet 114 can be defined as radial ports formed in an intermediate housing portion 111*b* of the gas lift device 100. The intermediate housing portion 111*b* may be connected to an upper housing portion 111*a* that extends to the latch (102; FIG. 2A) of the gas lift device 100. The nozzle structure 130 can be disposed in the chamber 112 of the intermediate housing section. A lower housing portion 111*c* can attach to the intermediate housing portion 111*b* and can hold the valve 120 and other features for the outlet 116 of the gas lift device 100.

Figure 7:
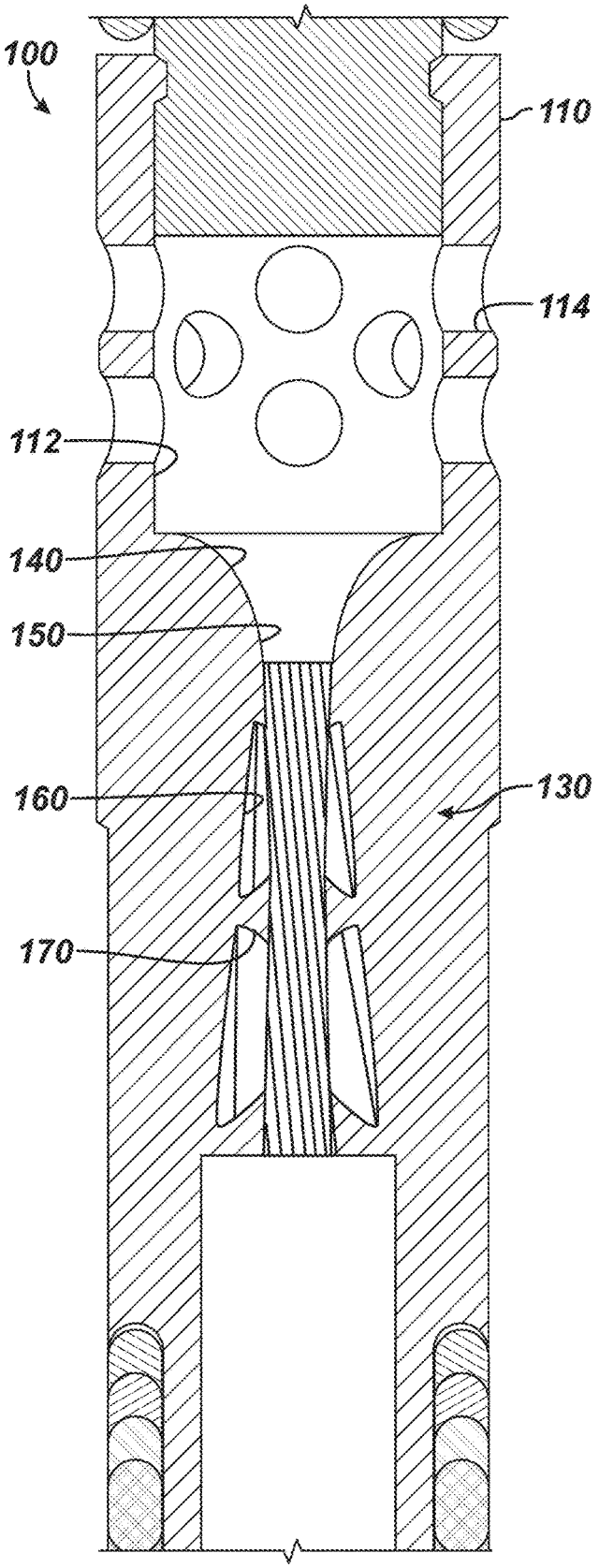
FIG. 7 illustrates an alternative configuration of a gas lift device of the present disclosure.

As discussed above, the nozzle structure 130 can be embodied as the flow control insert 131 to be positioned in the intermediate housing portion 111*b*. If manufacturing permits, however, the features of the nozzle structure 130 can be integrally formed in the housing 110 of the gas lift device 100. For example, FIG. 7 illustrates an alternative configuration of a gas lift device 100 of the present disclosure. The nozzle structure 130 is integrally formed, machined, cast, etc. in the chamber 112 of the housing 110 so that a separate insert is not used.

Figure 8:
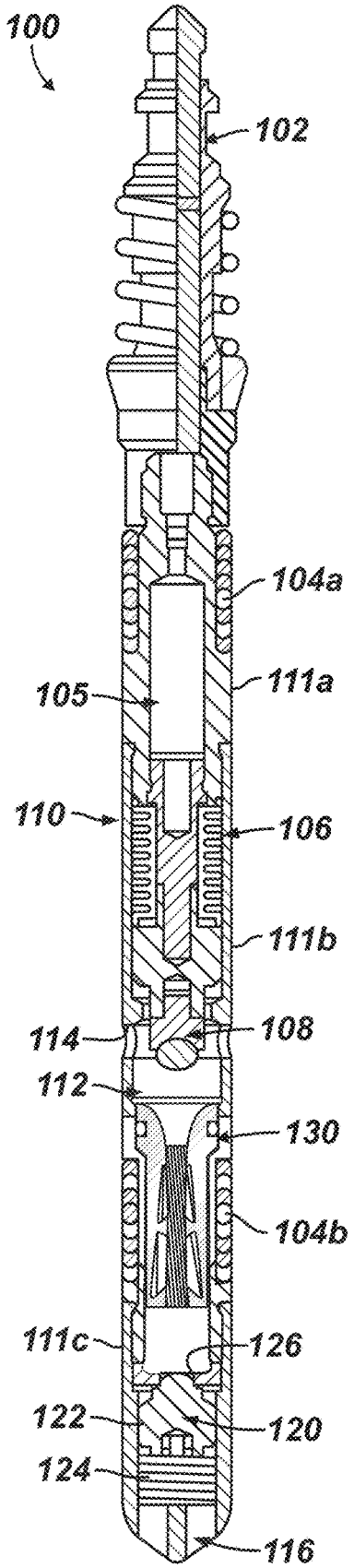
FIG. 8 illustrates a cross-sectional view of another gas lift device of the present disclosure.

As shown in FIG. 8, the gas lift device 100 of the present disclosure can further include a pressure-sensitive valve or valve piston 108 disposed in the chamber 112 and movable relative to the throat 150 (or other restriction, ball seat, or the like) in the housing 110 to throttle flow. Again, this gas lift device 100 is a type that installs inside a side pocket mandrel and can be retrieved using wireline or the like. As shown, the gas lift device 100 has upper and lower seals 104*a-b* separating an inlet 114, which is in communication with the housing's chamber 112. A valve piston 108 is biased closed by a gas charge dome 105 and a bellows assembly 106, which can use a convoluted bellows or an edge-welded bellows system. At its distal end, the valve piston 108 moves relative to the throat 150 (or other restriction, ball seat, or the like) in the chamber 112 in response to pressure on the bellows assembly 106 from the gas charge dome 105. A predetermined gas charge applied to the gas charge dome 105 and the bellows assembly 106 biases the valve piston 108 toward the throat 150. As the gas lift device 100 operates downhole, the bellows assembly 106 cycles in response to the pressure differential, and the valve piston 108 can throttle the gas flow from the inlet 114 to the nozzle structure 130.

As before, a valve 120, such as a check valve, is positioned downstream from the valve piston 108 and the nozzle structure 130. The valve 120 keeps fluid passing from the outlet 116 to the inlet 114. Yet, the valve 120 allows injected gas from the inlet 114 to pass out the outlet 116.

Figure 9A:
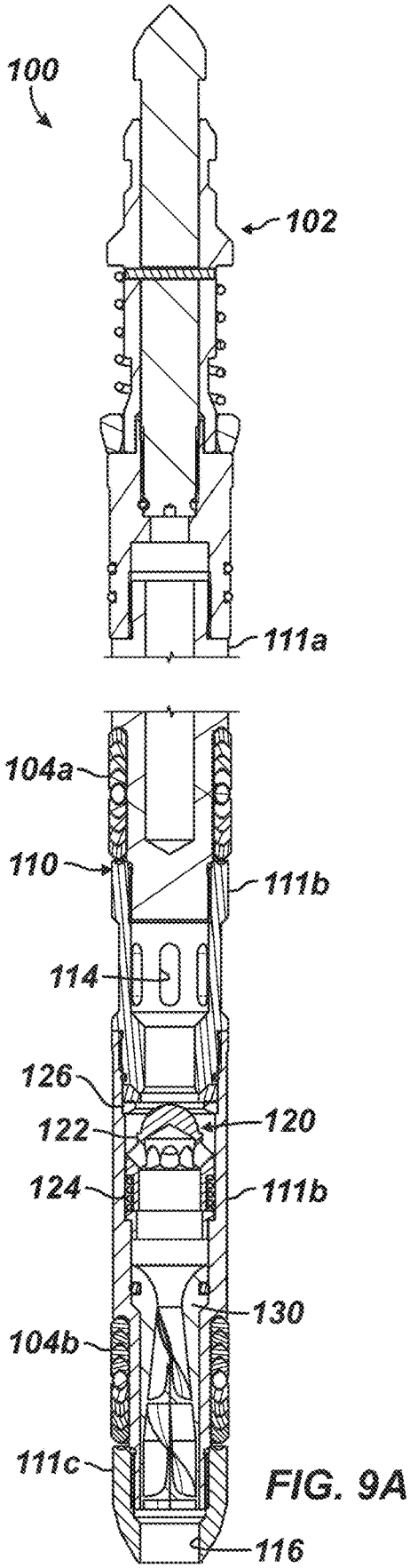
FIG. 9A illustrates a cross-sectional view of yet another gas lift device having a flow control structure of the present disclosure.
Figure 9B:
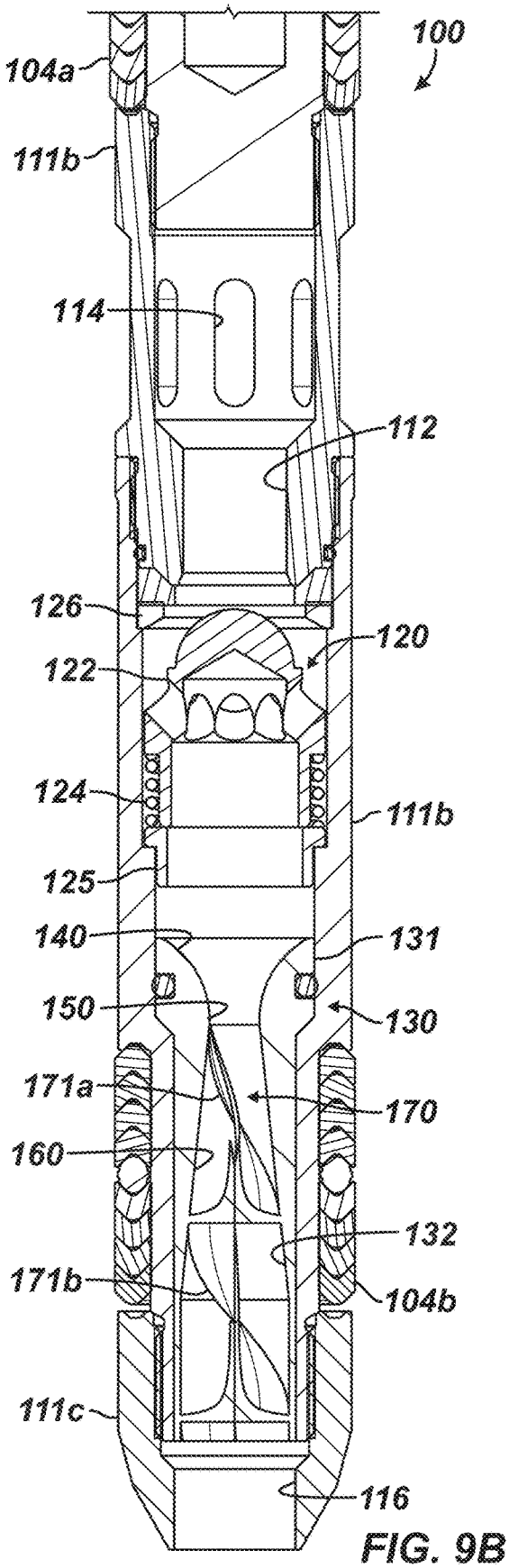
FIG. 9B illustrates a detail of FIG. 9A.
Figure 10B:
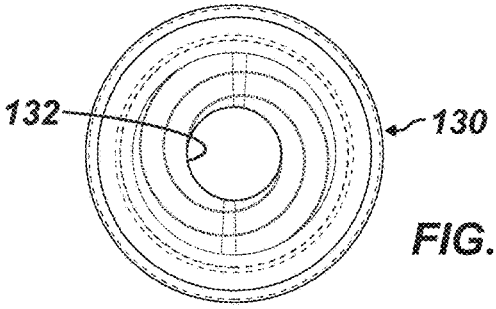
FIGS. 10A-10D illustrate side, top, cross-sectional, and bottom views of another flow control structure of the present disclosure.
Figure 10A:
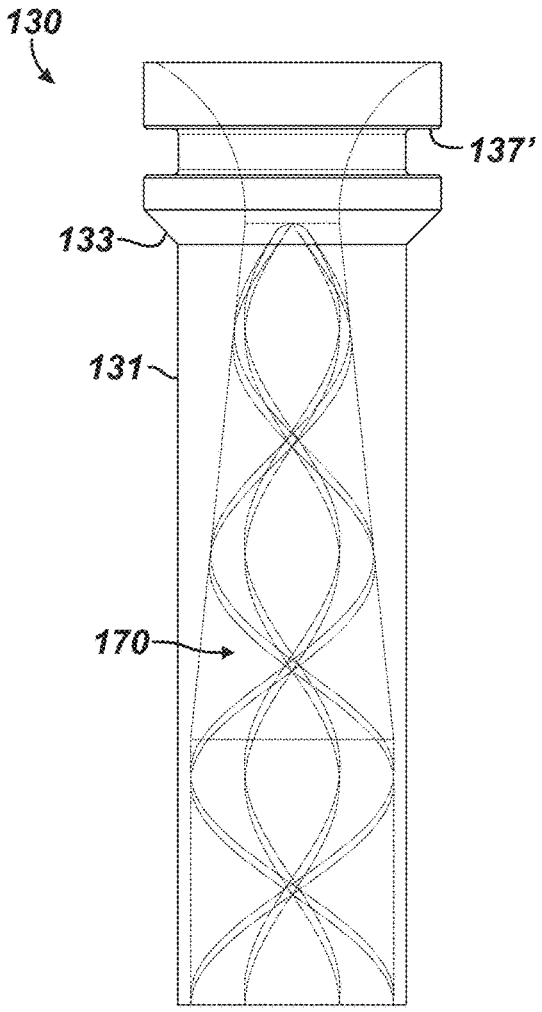
Figure 10C:
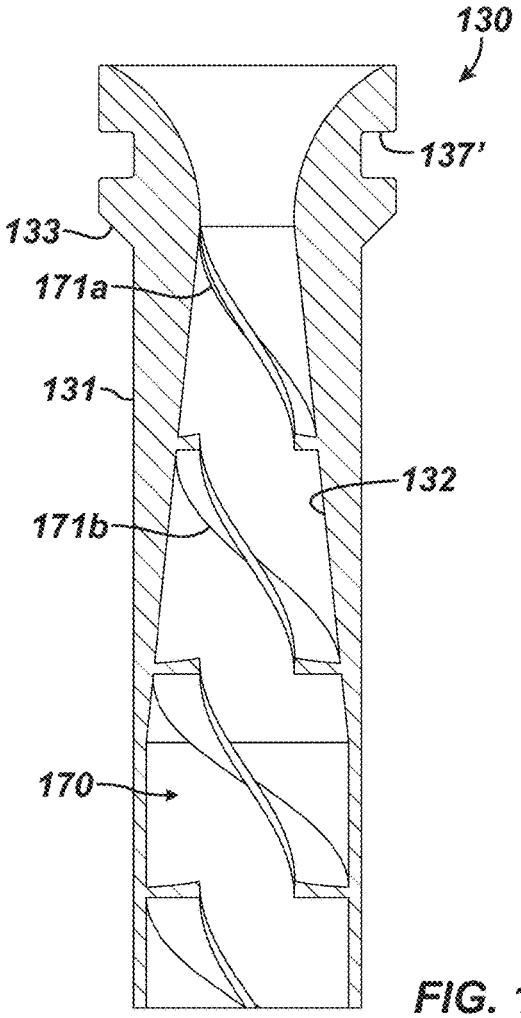
Figure 10D:
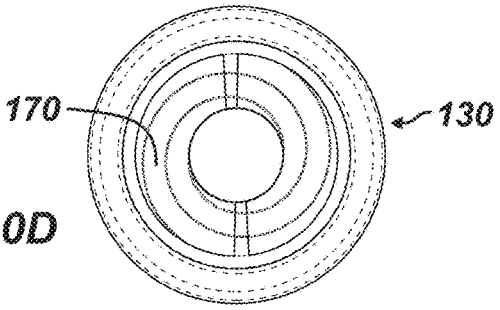
Figure 11A:
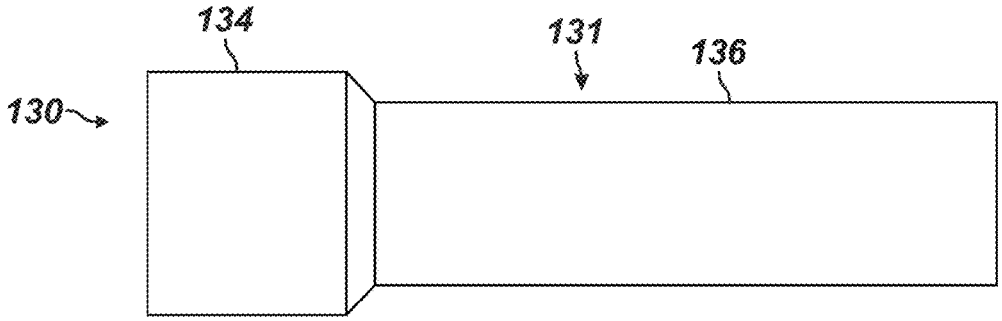
FIGS. 11A-11D illustrate side, cross-sectional, and perspective views another flow control structure for a gas lift device of the present disclosure.
Figure 11B:
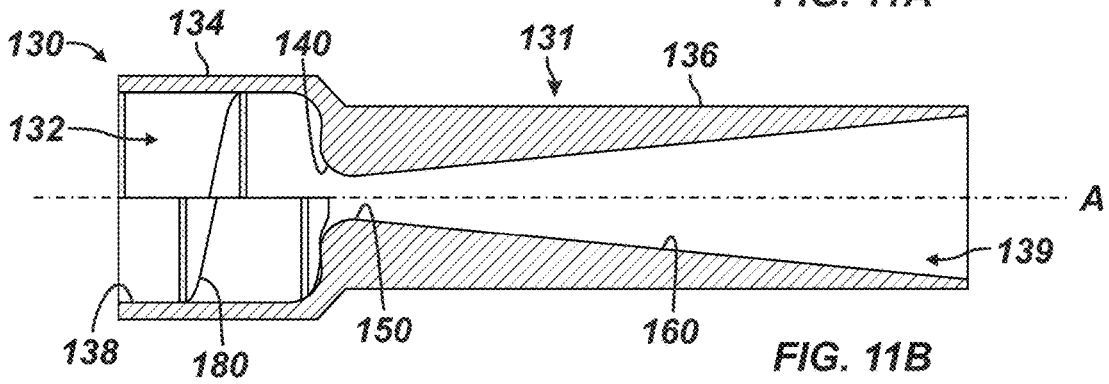
Figure 11C:
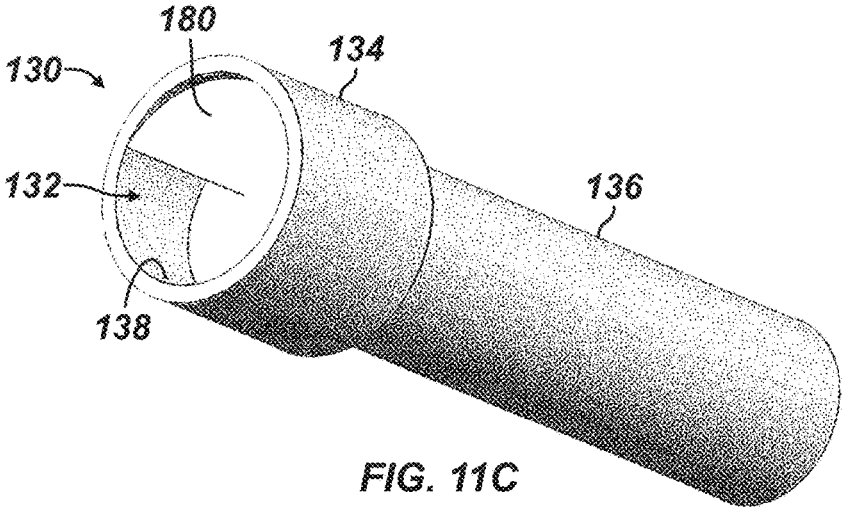
Figure 11D:
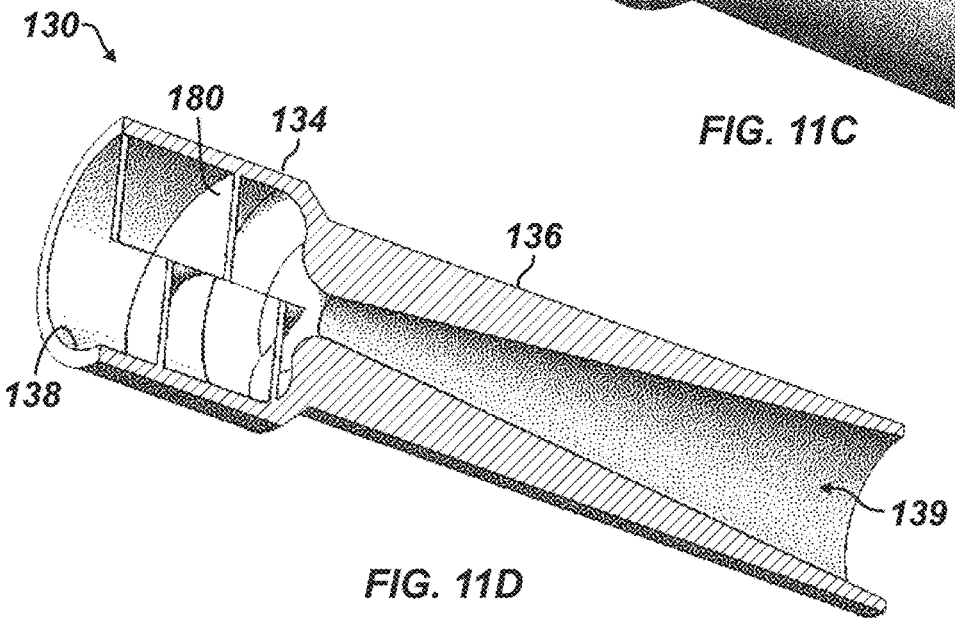

FIG. 9A illustrates a cross-sectional view of yet another gas lift device 100 having a flow control or nozzle structure 130 of the present disclosure. FIG. 9B illustrates a detail of FIG. 9A. Again, this gas lift device 100 is a type that installs inside a side pocket mandrel and can be retrieved using wireline or the like. As shown, the gas lift device 100 has upper and lower seals 104*a-b* separating an inlet 114, which is in communication with the housing's chamber 112.

The gas lift device 100 of the present disclosure can include a valve 120, such as a check valve, positioned upstream from the nozzle structure 130 (i.e., between the inlet 114 and the nozzle structure 130). The valve 120 includes a poppet 122 biased by a spring 124 toward a seat 126 in the housing's chamber 112. A fixture 125 can be used to retain the spring 124 in the chamber 112. The valve 120 keeps fluid passing from the outlet 116 to the inlet 114. Yet, the valve 120 allows injected gas from the inlet 114 to pass out the outlet 116.

The nozzle structure 130 shown here is a flow control insert 131, but could be integrated into at least a portion 111*b* of the device's housing 110. The nozzle structure 130 includes many of the same features as described above, including vanes 170 and including a converging section 140, a throat 150, and a diverging section 160 in the nozzle's open central area 132. For the vanes 170, two pairs of vanes 171*a-b* are disposed inside the open central area 132 on opposing sides. The vanes 171*a-b* both start spiraling together near the throat 150 and spiral at least twice along the length of the diverging section 160.

FIGS. 10A-10D illustrate side, top, cross-sectional, and bottom views of another flow control or nozzle structure 130 of the present disclosure. (Not all features similar to other configurations may be labelled.) Similar to the nozzle structure 130 described above, this nozzle structure 130 also has vanes 170 that include two pairs of vanes 171*a-b* disposed inside the open central area 132 on opposing sides. The vanes 171*a-b* both start spiraling together near the throat 150 and spiral at least three and half times along the length of the diverging section 160. In contrast to the previous configuration, these vanes 171*a-b* extend a smaller extent into the open central area 132 of the nozzle structure 130.

FIGS. 11A-11D illustrate side, cross-sectional, and perspective views another flow control or nozzle structure 130 for a gas lift device of the present disclosure. In this configuration, the nozzle structure 130 is a flow control insert 131, such as described above, so the flow control insert 131 can be inserted into a gas lift valve. The nozzle structure 130 has an inlet section 134 and an outlet section 136. The inlet section 134 defines a pocket 138 that is placed in communication with the chamber (112) of the gas lift valve in which the nozzle structure 130 is used. One or more vanes 180 formed in the pocket 138 extend inwardly toward the longitudinal axis A and spiral about the longitudinal axis A. As shown here, one or more vanes 180 spiral about the longitudinal axis A. The one or more spiraling vanes 180 delivers fluid from the inlet section 134 to the outlet section 136. For its part, the outlet section 136 has a nozzle feature 139, which can have the form of a convergent-divergent nozzle, a de Laval nozzle, a venturi, or the like. Similar to other configurations discussed above, for example, the nozzle feature 139 can have a converging section or nozzle inlet 140, a throat 150, and a diverging section or nozzle exit 160 extending along a longitudinal axis A. The converging section 140 has a converging surface that converges inward from the pocket 138 to the throat 150 and that is configured to funnel the fluid communication in the pocket 138 to the throat 150 of the outlet section 136. In turn, the throat 150 has a flow restriction configured to restrict the fluid communication from the converging section 140 to the diverging section 160 of the outlet section 136. For its part, the diverging section 160 has a diverging surface that diverges outwardly from the throat 150 toward the outlet 116.

The one or more spiraling vanes 180 produces swirl in the gas flow. The flow of gas through the outlet section 136 can go through a venturi effect, passing through the asymmetric hourglass shape of the surfaces and the restriction of the outlet section 136. The pressure of the gas decreases and its velocity increases as the gas flows through the throat 150 to the diverging section 160. Due to the swirl in the gas from the one or more spiraling vanes 180, turbulence in the gas flow can be decreased through the nozzle structure 130, and the gas flow becomes more laminar. The gas flow, which is compressible, can be further accelerated through the nozzle structure 130 by the conversion of the thermal energy of the flow into kinetic energy.

Figure 12:
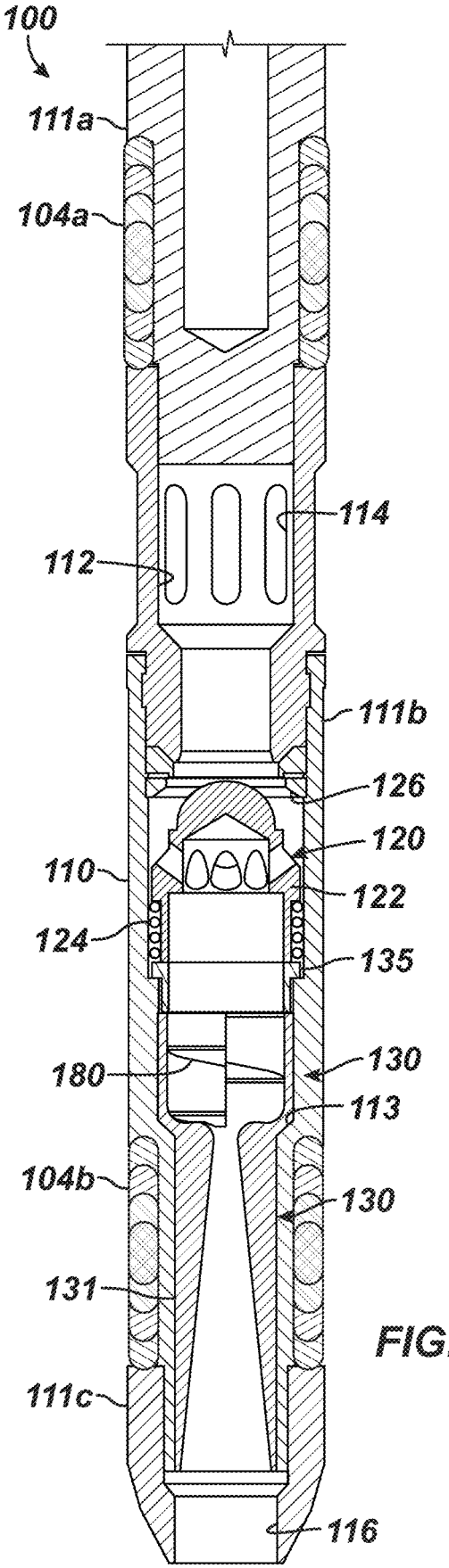
FIG. 12 illustrates another configuration of a gas lift device of the present disclosure.

For assembly and manufacturing purposes, the nozzle structure 130 as shown in FIG. 11A-11D can be comprised of a flow control insert 131 that is inserted in a chamber of a gas lift valve. For example, FIG. 12 illustrates another configuration of a gas lift device having a flow control insert 131 of the nozzle structure 130 disposed therein. As shown, the flow control insert 131 is inserted in the chamber 112 between the inlet 114 and the outlet 116. The flow control insert 131 has an inner passage therethrough in which the converging section 140, the throat 150, and the diverging section 160 are formed. In this configuration, the chamber 112 can define a shoulder 113, and the flow control insert 131 can be disposed against the shoulder 113. A fixture 135, such as a spacer or liner, can be engaged between the flow control insert 131 and the chamber 112 to hold the flow control insert 131 against the shoulder 113. A seal (not shown) can be engaged between the flow control insert 131 and the chamber 112 to seal an annular area therebetween.

The nozzle structure 130 is a continuously open feature that allows the gas to flow through the device 100. As noted, the sidewall of the chamber 112 through the nozzle structure 130 can follow an asymmetric hourglass shape. Gas flow passing through the nozzle structure 130 experiences a drop in pressure and an increase in velocity across the throat 150. The gas flow passing through the nozzle structure 130 also experiences a drop in temperature across the throat 150. In this way, the gas flow, which is compressible, can be further accelerated through the nozzle structure 130 by the conversion of the thermal energy of the flow into kinetic energy.

The gas flow also experiences spinning by virtues of the one or more spiraling vanes 180. The spinning gas introduces a further low-pressure force downstream, which draws more gas into the gas lift device 100. As a result, turbulence in the gas flow is decreased and the gas flow becomes more laminar. The injection of gas is therefore increased so that more gas can move through the gas lift device 100. The gas will also stay in a more laminar state as it flows through the gas lift device 100 because of the increased surface area of the one or more spiraling vanes 180. Turbulence is reduced in the gas flow, which will increase fluid flow efficiency of the gas lift device 100. The quantity, degree of rotation, and length of the one or more spiraling vanes 180 can change based on the gas lift requirements.

Accordingly, as will be appreciated, the contours and geometries of the surfaces of the sections (140, 150, 160) can be configured to provide desired results depending on the expected fluid(s), pressure(s), and flow rate(s) for a given implementation. Additionally, variations in the diameter of the open central area 132, relationships or ratios between the axial extents of the sections (140, 150, 160), and the number of turns of the vanes 180 can be selected and configured to impact the flow and to induce rotating flow suitable for the given implementation.

In the example of FIG. 12, the housing 110 is configured to position in a side pocket of a bore in a mandrel. Accordingly, the housing 110 has first and second annular seals 104*a-b* disposed externally thereabout. The inlet 114 defined in the housing 110 between the first and second annular seals 104*a-b*. When installed in the mandrel, the outlet 116 is placed in communication with the bore of the mandrel.

In other examples as noted herein, the housing 110 can be configured to affix to an opening externally on a mandrel. For example, the distal end of the housing 110 can thread into a fixture of the mandrel. The inlet 114 would be placed in communication with the wellbore annulus, and the outlet 116 would be placed in communication with a bore of the mandrel.

The housing 110 of the device 100 as shown in FIG. 12 can be formed of several housing portions to facilitate manufacture and assembly. The inlet 114 can be defined as radial ports formed in a ported housing portion 111*d* of the gas lift device 100. The ported housing portion 111*d* may be connected to an upper housing portion 111*a* that extends to a latch (102; FIG. 2A) of the gas lift device 100. The nozzle structure 130 can be disposed in the chamber 112 of the intermediate housing portion 111*b*. An outlet housing portion 111*c* can attach to the intermediate housing portion 111*b*.

As further shown in FIG. 12, the gas lift device 100 of the present disclosure can include a valve 120 positioned between the inlet 114 and outlet 116. The valve 120 keeps fluid passing from the outlet 116 to the inlet 114. Yet, the valve 120 allows injected gas from the inlet 114 to pass out the outlet 116. As shown here, the valve 120 is positioned upstream of the nozzle structure 130 so that any flow obstruction caused by the valve 120 occurs upstream of the benefits of the nozzle structure 130.

The valve 120 can be a check valve and can have a poppet 122 moveably disposed in the chamber 112 between an opened condition and a closed condition relative to a seat 126 disposed in the chamber 112. The poppet 122 can be biased by a spring 124 to the closed condition. During use, the poppet 122 is moveable from the closed condition to the opened condition away from the seat 126 in response to a pressure differential overcoming the bias of the spring 124.

Figure 13A:
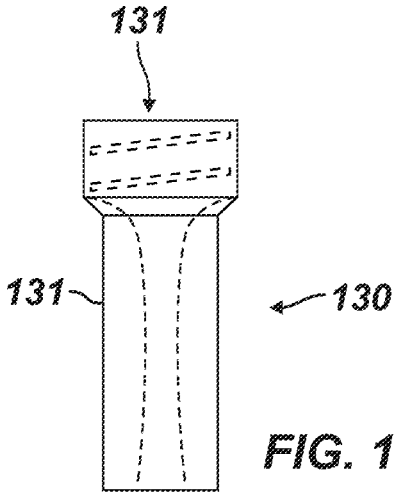
FIGS. 13A-13B illustrate an insert for the disclosed nozzle structure of the present disclosure implemented as a unitary component or separate components.
Figure 13B:
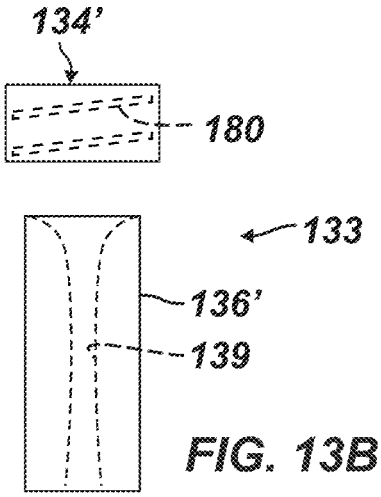
Figure 14A:
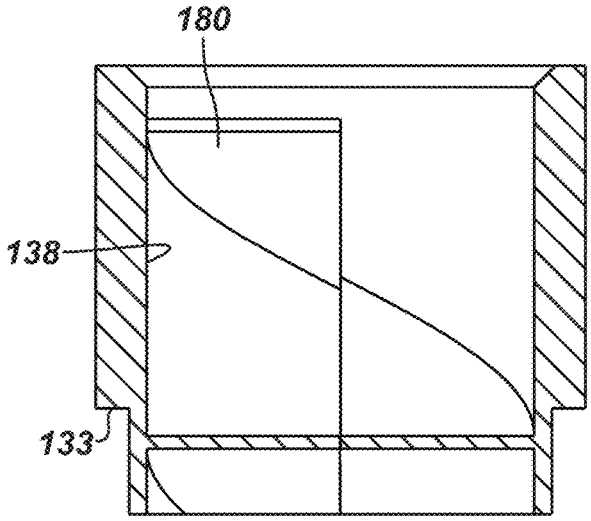
FIGS. 14A-14D illustrate cross-sectional, top, side, and bottom views of a separate component for an insert disclosed herein.
Figure 14B:
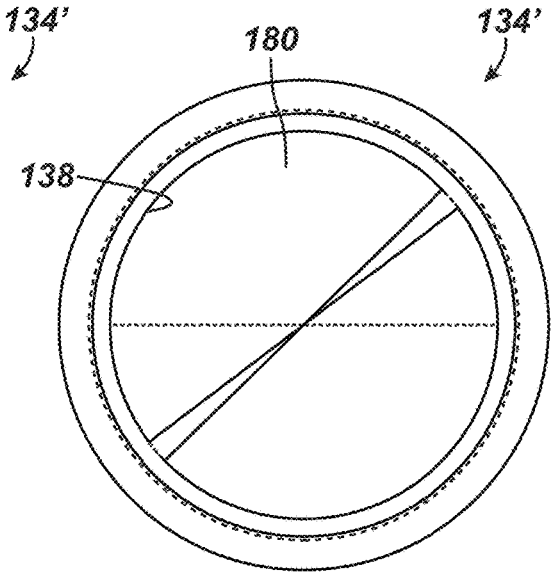
Figure 14C:
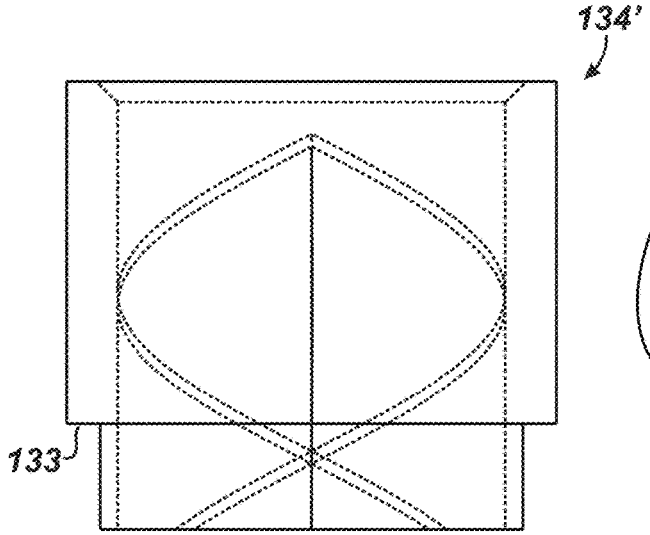
Figure 14D:
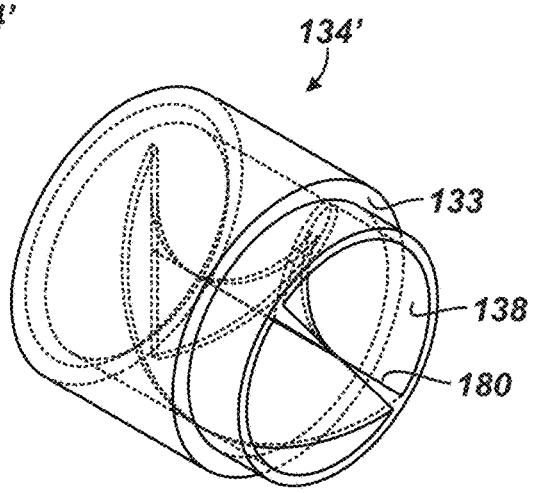

As disclosed herein and shown in FIG. 13A, a flow control insert 131 for the nozzle structure 130 can be a unitary body or component to be disposed in the gas lift valve. Likewise, as shown FIG. 13B, a flow control assembly 133 having separate bodies or components, a nozzle component 136' having the nozzle feature 139 and a vane component 134' having the vane(s) 180, can be used.

In another configuration if manufacturing permits, the nozzle structure 130 can be integrally formed, machined, cast, or the like in the sidewall of the chamber defined in the gas lift valve in which the nozzle structure 130 is used. In that sense, the features of the nozzle structure 130 of FIGS. 11A-11D can be integrally formed in with a housing portion of a gas lift valve, similar to the configuration of FIG. 7 discussed above, so that a separate insert is not used.

FIGS. 14A-14D illustrate cross-sectional, top, side, and bottom views of a separate vane component 134' for a flow control assembly (133) disclosed herein. This vane component 134' includes the one or more vanes 180, shown here as a pair of vanes opposing one another inside the pocket 138 and spiraling about one time along the length of the vane component 134'. This vane component 134' can be used with a nozzle component (136') as noted above.

As disclosed above, the inventive concepts can be embodied as a gas lift device 100. A nozzle structure 130 of the present disclosure can be part of a gas lift device used in a gas lift system. The nozzle structure 130 can be integrally formed in a chamber 112 of the gas lift device 100, or the nozzle structure 130 can be a flow control insert 131 insertable in the chamber 112 of the gas lift device 100.

Figure 15A:
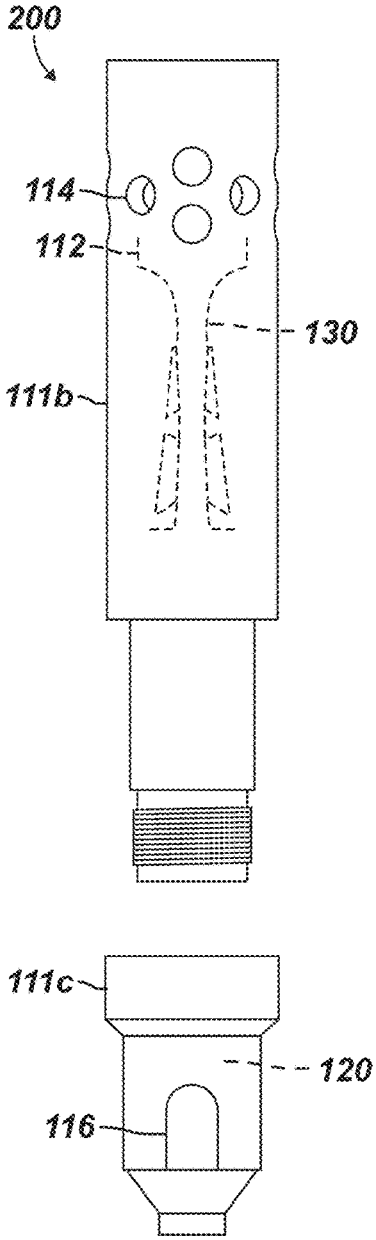
FIGS. 15A-15C illustrate kits of the present disclosure for retrofitting a gas lift device.
Figure 15B:
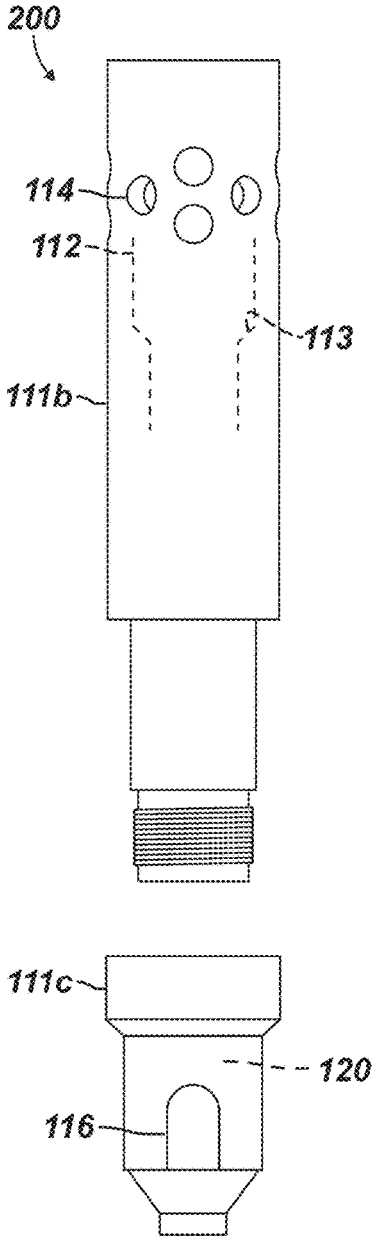

The inventive concepts can also be embodied as a kit to retrofit an existing gas lift device. FIGS. 15A-15B illustrate kits 200 of the present disclosure for retrofitting a gas lift device (not shown).

For example, the kit 200 can include a housing portion (e.g., intermediate housing portion 111*b* of FIGS. 3A-3B). The housing portion 111*b* is configured to connect to other portions of an existing gas lift device and defines the chamber 112 communicating therethrough. The housing portion 111*b* can also include an inlet 114.

As noted and as shown in FIG. 15A, the nozzle structure 130 can be integrally formed in the chamber 112 of the housing portion 111*b*. Accordingly, the housing portion 111*b* of the kit 200 can have an integrally formed nozzle structure 130 as in FIG. 6 (or one of the other structure disclosed herein).

Alternatively, as shown in FIG. 15B, the nozzle structure 130 can be insertable in the chamber 112 of the housing portion 111*b*. For example, the kit 200 can include a flow control insert 131 for the nozzle structure 130 as in FIGS. 3A-3B, 4A-4D, and 5A-5D that inserts in the chamber 112. As noted above, the nozzle structure 130 for the kit 200 has the converging section (140), the throat (150), the diverging section (160), and the vanes (170), as discussed above.

Figure 15C:
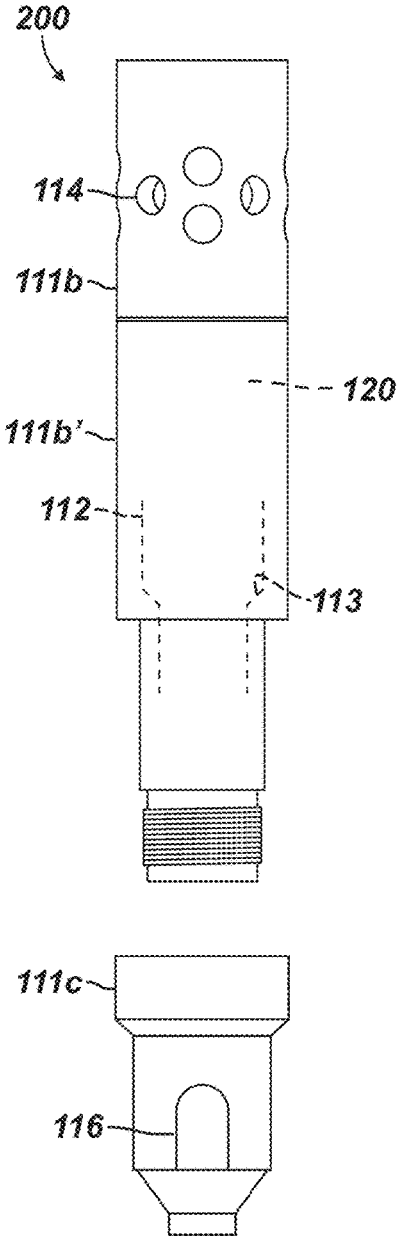

As shown in FIGS. 15A-15C, the kit 200 can also include an outlet housing portion 111*c* of FIGS. 3A, 8, and 12 configured to connect to the housing portion 111*b*. The outlet housing portion 111*c* can have the outlet 116. The kit 200 can include additional components, such as seals (104*a*-*b*) and the like.

In FIGS. 15A-15B, the outlet housing portion 111*c* can hold a valve (120), being configured to permit fluid communication from the inlet 114 toward the outlet 116 and being configured to prevent fluid communication from the outlet 116 toward the inlet 114.

In FIG. 15C, a valve (120) can be disposed in the other housing portion, which can have separate portions 111*b*, 111*b*' as shown. This arrangement can be similar to that shown in FIG. 12 in which the valve (120) is disposed upstream of the nozzle structure (130) when inserted in the housing portion 111*b*'. In any event, the valve (120) is configured to permit fluid communication from the inlet 114 toward the outlet 116 and is configured to prevent fluid communication from the outlet 116 toward the inlet 114.

Configurations of the present disclosure can be characterized by the following:

Clause 1: A gas lift device (100) for use on tubing in a wellbore, the gas lift device (100) comprising: a housing (110) defining a chamber (112) and defining an inlet (114) and an outlet (116) in communication with the chamber (112); and a nozzle structure (130) disposed in the chamber (112) and defining a flow passage therethrough along a longitudinal axis (A), the nozzle structure (130) having one or more vanes (170, 180) extending inwardly in the flow passage toward the longitudinal axis, the one or more vanes (170) spiraling about the longitudinal axis, the nozzle structure (130) having a converging section (140), a throat (150), and a diverging section extending along the longitudinal axis, the converging section (140) having a converging surface converging inwardly to the throat (150), the converging surface being configured to funnel fluid communication to the throat (150), the throat (150) defining a flow restriction (151), the flow restriction (151) being configured to restrict fluid communication from the converging section (140) to the diverging section (160), the diverging section (160) having a diverging surface diverging outwardly from the throat (150), the diverging section (160) being configured to direct fluid communication out of the nozzle structure (130) toward the outlet (116).

Clause 2: The gas lift device (100) of Clause 1, wherein the chamber (112) of the housing (110) defines the nozzle structure (130) integrally formed therein; or the nozzle structure (130) comprises an insert (131) inserted in the chamber (112) between the inlet (114) and the outlet (116), the insert (131) having the one or more vanes (170, 180), the converging section (140), the throat (150), and the diverging section.

Clause 3: The gas lift device (100) of Clause 1 or 2, further comprising a valve (120) disposed in the chamber (112), the valve (120) being configured to permit fluid communication from the inlet (114) toward the outlet (116) and being configured to prevent fluid communication from the outlet (116) toward the inlet (114).

Clause 4: The gas lift device (100) of Clause 3, wherein: the valve (120) comprises a poppet (122) moveably disposed in the outlet (116) between an opened condition and a closed condition, the poppet (122) being biased by a spring (124) toward the closed condition, the poppet (122) being moveable from the closed condition to the opened condition in response to a pressure differential overcoming a bias of the spring (124); the valve (120) is disposed in the chamber (112) between the inlet (114) and the nozzle structure (130); or the valve (120) is disposed in the chamber (112) between the nozzle structure (130) and the outlet (116).

Clause 5: The gas lift device (100) of any one of Clauses 1 to 4, wherein the nozzle structure (130) comprises an inlet section and an outlet section, the inlet section defining a pocket communicating the chamber (112) with the outlet section, the pocket having the one or more vanes (170) extending inwardly toward the longitudinal axis, the outlet section having the converging section (140), the throat (150), and the diverging section.

Clause 6: The gas lift device (100) of any one of Clauses 1 to 4, wherein the one or more vanes (170) extend inwardly from the diverging surface toward the longitudinal axis.

Clause 7: The gas lift device (100) of Clause 6, wherein the one or more vanes (170) have inner edges (174) exposed in the diverging section (160), the inner edges (174) defining an open central area (132) through the diverging section (160), the open central area (132) restricting inward from the throat (150) to an intermediate location of the open central area (132) and diverging outwardly from the intermediate location to an end (107) of the diverging section (160).

Clause 8: The gas lift device (100) of any one of Clauses 1 to 9, wherein one or more of a number of the one or more vanes (170), a thickness (176) of the one or more vanes (170), an inward extent (172) of the one or more vanes (170), and a circumferential turn of the one or more vanes (170) spiraling about the longitudinal axis is configured to produce laminar flow of the fluid communication from the inlet (114) to the outlet (116).

Clause 9: The gas lift device (100) of any one of Clauses 1 to 8, comprising a pressure-sensitive valve disposed in the chamber (112) and being movable relative to the nozzle structure (130).

Clause 10: A gas lift system for use on tubing in a wellbore, the gas lift system comprising: a mandrel configured to position on the tubing in the wellbore, the mandrel having a bore; and a gas lift device (100) according to any one of Clauses 1 to 9 and being configured to position on the mandrel.

Clause 11: The gas lift device (100) of Clause 14, wherein the nozzle structure (130) comprises an insert (131) inserted in the chamber (112) between the inlet (114) and the outlet (116), the insert (131) defining a flow passage having the converging section (140), the throat (150), and the diverging section; and wherein the chamber (112) defines a shoulder (113), the insert (131) being disposed against the shoulder; wherein the gas lift device (100) comprises a fixture (135) engaged between the insert (131) and the chamber (112) and holding the insert (131) against the shoulder; and wherein the gas lift device (100) comprises a seal (137) engaged between the insert (131) and the chamber (112) and sealing an annular area therebetween.

Clause 12: A kit configured to retrofit a gas lift device (100) used on tubing in a wellbore, the kit comprising: a housing portion configured to connect to the gas lift device (100), the housing portion defining a chamber communicating therethrough; and a nozzle structure (130) according to any one of Clauses 1 to 9 disposed in the chamber.

Clause 13: The kit of Clause 12, further comprising a valve (120) being configured to insert in the housing portion, the valve (120) being configured to permit fluid communication from an inlet (114) of the gas lift device (100) toward an outlet (116) of the gas lift device (100) and being configured to prevent fluid communication from the outlet (116) toward the inlet (114).

Clause 14: The kit of any one of Clauses 12 or 13, wherein the nozzle structure (130) is integrally formed in the chamber of the housing portion; or wherein the nozzle structure (130) comprises an insert (131) insertable in the chamber of the housing portion, the insert (131) having the one or more vanes (170, 180), the converging section (140), the throat (150), and the diverging section.

Clause 15: A method of producing downhole fluid to surface using tubing in a wellbore, the method comprising: permitting gas to flow through an inlet (114) into a chamber (112) of a gas lift device (100); funneling the gas from the inlet (114) through a converging section (140) of a nozzle structure (130) in the chamber; restricting the gas from the converging section through a throat (150) to a diverging section (160) of the nozzle structure; diverging the gas with a diverging surface of the diverging section (160) diverging outwardly from the throat (150) toward an outlet (116) of the gas lift device (100); imparting rotation to the gas toward the outlet (116) using one or more vanes (170, 180) extending inwardly toward a longitudinal axis of the nozzle structure and spiraling about the longitudinal axis; and outputting the gas from the outlet (116) of the gas lift device (100) to communicate with the downhole fluid.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gas lift device for use on tubing in a wellbore, the gas lift device comprising:

a housing defining a chamber and defining an inlet and an outlet in communication with the chamber; and a nozzle structure disposed in the chamber and defining a flow passage therethrough along a longitudinal axis, the nozzle structure having one or more vanes extending inwardly in the flow passage toward the longitudinal axis, the one or more vanes spiraling about the longitudinal axis, the flow passage of the nozzle structure having a converging section, a throat, and a diverging section extending along the longitudinal axis, the converging section having a converging surface converging inwardly to the throat, the converging surface being configured to funnel fluid communication to the throat, the throat defining a flow restriction, the flow restriction being configured to restrict fluid communication from the converging section to the diverging section, the diverging section having a diverging surface diverging outwardly from the throat, the diverging section being configured to direct fluid communication out of the nozzle structure toward the outlet.

2. The gas lift device of claim 1, wherein the chamber of the housing defines the nozzle structure integrally formed therein.

3. The gas lift device of claim 1, wherein the nozzle structure comprises an insert inserted in the chamber between the inlet and the outlet, the insert having the one or more vanes, the converging section, the throat, and the diverging section.

4. The gas lift device of claim 3, wherein the chamber defines a shoulder, the insert being disposed against the shoulder; wherein the gas lift device comprises a fixture engaged between the insert and the chamber and holding the insert against the shoulder; and wherein the gas lift device comprises a seal engaged between the insert and the chamber and sealing an annular area therebetween.

5. The gas lift device of claim 1, further comprising a valve disposed in the chamber, the valve being configured to permit fluid communication from the inlet toward the outlet and being configured to prevent fluid communication from the outlet toward the inlet.

6. The gas lift device of claim 5, wherein:

the valve comprises a poppet moveably disposed between an opened condition and a closed condition, the poppet being biased by a spring toward the closed condition, the poppet being moveable from the closed condition to the opened condition in response to a pressure differential overcoming a bias of the spring;

the valve is disposed in the chamber between the inlet and the nozzle structure; or the valve is disposed in the chamber between the nozzle structure and the outlet.

7. The gas lift device of claim 1, wherein the nozzle structure comprises an inlet section and an outlet section, the inlet section defining a pocket communicating the chamber with the outlet section, the pocket having the one or more vanes extending inwardly toward the longitudinal axis, the outlet section having the converging section, the throat, and the diverging section.

8. The gas lift device of claim 7, wherein the nozzle structure comprises an insert having a vane component for the inlet section and having a nozzle component for the outlet section, the vane component and the nozzle component being separate components from one another.

9. The gas lift device of claim 1, wherein the one or more vanes extend inwardly from the diverging surface toward the longitudinal axis.

10. The gas lift device of claim 9, wherein the one or more vanes have inner edges exposed in the diverging section, the inner edges defining an open central area within the flow passage through the diverging section, the open central area restricting inward from the throat to an intermediate location of the open central area and diverging outwardly from the intermediate location to an end of the diverging section.

11. The gas lift device of claim 1, wherein one or more of: a number of the one or more vanes, a thickness of the one or more vanes, an inward extent of the one or more vanes, and a circumferential turn of the one or more vanes spiraling about the longitudinal axis is configured to produce laminar flow of fluid communication through the nozzle structure from the inlet to the outlet.

12. The gas lift device of claim 1, wherein the one or more vanes define at least two circumferential turns spiraling about the longitudinal axis.

13. The gas lift device of claim 1, further comprising a pressure-sensitive valve disposed in the chamber and being movable relative to the nozzle structure.

14. The gas lift device of claim 13, wherein the pressure-sensitive valve comprises:

a piston movably disposed in the chamber along the longitudinal axis; and a bellows connected between the chamber and the piston, the bellows separating a first portion of the chamber having the inlet from a second portion of the chamber holding a pressure charge.

15. The gas lift device of claim 1, wherein:

the housing is configured to position in a side pocket of a bore in a mandrel, the housing having first and second annular seals disposed externally thereabout, the inlet defined in the housing between the first and second annular seals, the outlet being in communication with the bore of the mandrel; or the housing is configured to affix to an opening externally on a mandrel, the inlet being in communication with an annulus, the outlet being in communication with a bore of the mandrel.

16. A gas lift system for use on tubing in a wellbore, the gas lift system comprising:

a mandrel configured to position on the tubing in the wellbore, the mandrel having a bore; and a gas lift device according to claim 1 and being configured to position on the mandrel.

17. A kit configured to retrofit a gas lift device used on tubing in a wellbore, the kit comprising:

a housing portion configured to connect to the gas lift device, the housing portion defining a chamber communicating therethrough; and a nozzle structure disposed in the chamber and defining a flow passage therethrough along a longitudinal axis, the nozzle structure having one or more vanes extending inwardly in the flow passage toward the longitudinal axis, the one or more vanes spiraling about the longitudinal axis, the flow passage of the nozzle structure having a converging section, a throat, and a diverging section extending along the longitudinal axis, the converging section having a converging surface converging inwardly to the throat, the converging section being configured to funnel fluid communication to the throat, the throat defining a flow restriction, the flow restriction being configured to restrict fluid communication from the converging section to the diverging section, the diverging section having a diverging surface diverging outwardly from the throat, the diverging section being configured to direct fluid communication out of the nozzle structure.

18. The kit of claim 17, further comprising a valve being configured to insert in the housing portion, the valve being configured to permit fluid communication from an inlet of the gas lift device toward an outlet of the gas lift device and being configured to prevent fluid communication from the outlet toward the inlet.

19. The kit of claim 17, wherein the nozzle structure is integrally formed in the chamber of the housing portion; or wherein the nozzle structure comprises an insert insertable in the chamber of the housing portion, the insert having the one or more vanes, the converging section, the throat, and the diverging section.

20. A method of producing downhole fluid to surface using tubing in a wellbore, the method comprising:

permitting gas to flow through an inlet into a chamber of a gas lift device;

funneling the gas from the inlet through a converging section of a nozzle structure in the chamber;

restricting the gas from the converging section through a throat of the nozzle structure to a diverging section of the nozzle structure;

diverging the gas with a diverging surface of the diverging section diverging outwardly from the throat toward an outlet of the gas lift device;

imparting rotation to the gas toward the outlet using one or more vanes, the one or more vanes extending inwardly toward a longitudinal axis of the nozzle structure and spiraling about the longitudinal axis; and outputting the gas from the outlet of the gas lift device to communicate with the downhole fluid.

* * * * *